US007744078B2

(12) United States Patent
Gromadzki et al.

(10) Patent No.: US 7,744,078 B2
(45) Date of Patent: Jun. 29, 2010

(54) METHODS AND APPARATUS FOR STORING SLIP-SHEETS

(75) Inventors: Jo A. L. Gromadzki, Vancouver (CA); Martin C. Wight, White Rock (CA)

(73) Assignee: Eastman Kodak Company, Rochester, NY (US)

( * ) Notice: Subject to any disclaimer, the term of this patent is extended or adjusted under 35 U.S.C. 154(b) by 528 days.

(21) Appl. No.: 11/668,550

(22) Filed: Jan. 30, 2007

(65) Prior Publication Data

US 2008/0179004 A1 Jul. 31, 2008

(51) Int. Cl.
*B41F 27/12* (2006.01)

(52) U.S. Cl. ..... 271/14; 271/19; 101/477

(58) Field of Classification Search ..... 271/12–14, 271/292, 294, 287, 4.11, 10.14–10.16, 42, 271/267, 213; 156/344, 584; 101/407.1, 101/477, 408; 414/790.9, 793, 796.9, 797; 270/58.33

See application file for complete search history.

(56) References Cited

U.S. PATENT DOCUMENTS 4,081,085 A * 3/1978 Haenni ..... 414/19
4,212,263 A 7/1980 Hillhouse
4,402,592 A 9/1983 Schon et al.
4,667,948 A 5/1987 Angelbeck et al.
5,145,164 A 9/1992 Kan
5,257,444 A * 11/1993 Nishiyama ..... 29/33 H
5,322,268 A 6/1994 Okutsu et al.
5,367,360 A 11/1994 McIlwraith et al.
5,655,452 A 8/1997 Blake et al.
5,788,455 A 8/1998 Krupica et al.
5,791,250 A 8/1998 Blake et al.
5,818,508 A 10/1998 Straayer et al.
5,992,324 A 11/1999 Rombult et al.
6,000,337 A * 12/1999 Blake et al. ..... 101/477
6,076,464 A * 6/2000 Okamura ..... 101/401.1
6,422,801 B1 * 7/2002 Solomon ..... 414/416.07
6,530,322 B1 3/2003 Ono et al.
6,561,097 B2 5/2003 Toyofuku
6,607,192 B2 8/2003 Ono et al.
6,619,208 B2 9/2003 Ono et al.
6,623,003 B1 9/2003 Koizumi et al.
6,651,561 B2 11/2003 Koizumi et al.
6,688,591 B2 2/2004 Larsen et al.
6,726,433 B1 4/2004 Blake et al.
6,729,237 B2 * 5/2004 Kawamura et al. ..... 101/477
6,729,837 B1 5/2004 Ono et al.
6,739,261 B2 * 5/2004 Ono ..... 101/477

(Continued)

FOREIGN PATENT DOCUMENTS

EP 1 061 019 12/2000

(Continued)

*Primary Examiner*—Patrick Mackey
*Assistant Examiner*—Jeremy Severson
(74) *Attorney, Agent, or Firm*—Nelson Adrian Blish

(57) ABSTRACT

The present invention provides a method and apparatus for storing a slip-sheet removed from a stack of interleaved slip-sheets and printing plates. A materials handling system separates a slip-sheet from a media stack that includes image recordable materials. A slip-sheet separates each of the image recordable materials from one another in the media stack. The slip-sheets removed from the stack are stored in a movable slip-sheet holder.

13 Claims, 25 Drawing Sheets

U.S. PATENT DOCUMENTS

| | | | | |
|---|---|---|---|---|
| 6,745,694 | B1 | 6/2004 | Ellis et al. | |
| 6,776,097 | B2 | 8/2004 | Takeda | |
| 6,779,793 | B2 | 8/2004 | Behrens et al. | |
| 6,904,844 | B2 | 6/2005 | Koizumi et al. | |
| 6,929,257 | B2 | 8/2005 | Richardson, Jr. et al. | |
| 6,935,238 | B2 * | 8/2005 | Kawamura et al. | 101/477 |
| 6,964,228 | B2 * | 11/2005 | Koizumi et al. | 101/477 |
| 6,966,966 | B2 * | 11/2005 | Koizumi et al. | 156/344 |
| 6,969,060 | B2 | 11/2005 | Bouchal et al. | |
| 6,978,716 | B2 * | 12/2005 | Takeda | 101/477 |
| 7,000,541 | B2 * | 2/2006 | Yee et al. | 101/408 |
| 7,044,056 | B2 | 5/2006 | Miyoshi | |
| 7,100,506 | B2 * | 9/2006 | Takeda | 101/477 |
| 7,152,531 | B2 * | 12/2006 | Miyoshi | 101/477 |
| 7,367,266 | B2 * | 5/2008 | Takeda et al. | 101/477 |
| 2003/0189281 | A1 * | 10/2003 | Larsen et al. | 271/42 |
| 2004/0112233 | A1 * | 6/2004 | Shibabuki et al. | 101/477 |
| 2004/0112534 | A1 * | 6/2004 | Koizumi et al. | 156/344 |
| 2004/0179922 | A1 | 9/2004 | Blake et al. | |
| 2005/0021754 | A1 | 1/2005 | Alda et al. | |
| 2006/0117975 | A1 | 6/2006 | Yee et al. | |
| 2006/0174790 | A1 | 8/2006 | Yee | |

FOREIGN PATENT DOCUMENTS

| | | |
|---|---|---|
| EP | 1 273 964 | 1/2003 |
| EP | 0 897 885 B1 | 10/2004 |
| JP | 2000-318850 | 11/2000 |
| JP | 2003-285941 | 10/2003 |
| WO | 2006/091558 | 8/2006 |

* cited by examiner

METHODS AND APPARATUS FOR STORING SLIP-SHEETS

CROSS REFERENCE TO RELATED APPLICATIONS

Reference is made to commonly assigned, co-pending U.S. patent application Ser. No. 11/668,504, filed Jan. 30, 2007, entitled "METHOD AND APPARATUS FOR SEPARATING A SLIP-SHEET FROM AN IMAGE RECORDABLE MATERIAL", in the name of Jo A. L. Gromadzki et al.; application Ser. No. 11/668,519, filed Jan. 30, 2007, entitled "METHODS AND APPARATUS FOR SEPARATING IMAGE RECORDABLE MATERIALS FROM A MEDIA STACK", in the name of William Yuen; and application Ser. No. 11/668,533, filed Jan. 30, 2007, entitled "A METHOD AND APPARATUS FOR SEPARATING MEDIA COMBINATIONS FROM A MEDIA STACK", in the name of William Yuen et al.

FIELD OF THE INVENTION

This invention relates to the field of imaging systems and more particularly to the field of removing and storing slip-sheets interspersed between a plurality of media sheets.

BACKGROUND OF THE INVENTION

In the commercial printing industry, an important step in the preparation of images for printing is the transfer of image information to an image recordable material that can be used repeatedly to print the image. While the image recordable material can take a variety of forms, one common form is the printing plate that includes a surface that can be modified in an image-wise fashion. Printing plates can take different forms. In one embodiment the modifiable surface includes a special coating referred to as an emulsion. An emulsion is radiation sensitive coating that changes properties when exposed to radiation such as visible, ultraviolet, or infrared light. An emulsion can include one or more layers that are coated onto a substrate. The substrate can be composed of a variety of materials such as aluminum, polyester or elastomers.

The transfer of image information to an image recordable material can be done in a variety of methods. One method in which image information is transferred to an image forming material is by computer-to-plate (CTP) systems. In CTP systems images are formed on the modifiable surface of an image recordable material by way of radiation beams or the like generated by an imaging head in response to image forming information. In this manner, images can be quickly formed onto the image recordable material.

The advent of CTP technology is part of an increasing trend towards automation in the printing industry. The increasing use of information technology to create and distribute electronic and print publications, coupled with the more widespread accessibility of such technologies is contributing to a greater demand for shorter print runs and faster turnaround times. These changes, in turn, have contributed to a greater push towards automating all aspects of the printing process.

Automating the printing industry does present some special technological hurdles, however. In the case of printing plates used in CTP systems, some of these hurdles result from the delicacy of the modifiable surfaces of these plates. These plates are easily marred, and if marred, can create undesirable defects in the final printed product. Any attempt to automate the handling of printing plates must include measures to prevent damage to the delicate modifiable surfaces of the plates.

Measures used to reduce marring of printing plates during storage or transport, however introduce additional problems for automation. Unexposed printing plates are normally supplied in packages in numbers that can range from a few dozen to several hundred with slip-sheets interspersed between adjacent printing plates. Slip-sheets are used to protect the sensitive surfaces of the printing plates by providing a physical barrier between printing plates. The slip-sheets must be removed from the printing plates prior to imaging.

The automation of slip-sheet removal and storage presents a number of challenges. Slip-sheet removal is not simply a matter of moving a single sheet from a stack of similar sheets. In general, slip-sheets are made from materials different from those used for printing plates (e.g. paper) and in particular, from materials suitable for not damaging the modifiable surfaces of the printing plates. Separating a slip-sheet from an adjacent plate can be complicated when the slip-sheet becomes adhered to a surface of the adjacent plate by physical mechanisms that can include electrostatic attraction or the expulsion of air between the surfaces. These mechanisms can lead to multiple plate picks that can lead to system error conditions. Increasing plate-making throughput requirements complicate matters further by necessitating that the slip-sheets be removed at rates that do not hinder the increased plate supply demands.

Conventional materials pickers have typically picked and removed printing plates and slip-sheets sequentially from a media stack. For example, in some conventional systems, a slip-sheet is first picked from the media stack and moved to a disposal container. Once the slip-sheet has been moved, a printing plate is then picked and moved to subsequent station where it is processed (e.g. imaging in an exposure engine). In other conventional systems, a slip-sheet is picked and transferred to a disposal container after the printing plate has been secured and transferred to a subsequent process. In either case, the sequential picking and removal steps can adversely affect the overall system throughput times. Increased throughput times can also arise when additional efforts expended to secure an additional sheet that is adjacent to a given sheet that is being removed from the media stack. In such a case, these efforts are required to prevent the additional sheet from being removed accidentally along with the given sheet. Conventional methods have typically employed media cassettes with passive or fixed separation plates or toothed structures to attempt to separate an underlying adhered sheet when a given sheet is lifted out of the cassette. In these conventional methods, the separation of the underlying sheet needs to occur over a limited amount of travel dictated by the distance between the given sheet and the fixed separation plate as the given sheet is lifted out of the cassette. Further, if the underlying sheet has not been separated from the given sheet, these conventional separation methods cannot easily be repeated when the given sheet is lifted out of the cassette to a position wherein the fixed separation plates no longer contact the given sheet.

Some conventional systems attempt to remove slip-sheets and printing plates simultaneously from a media cassette and convey them to a second location to be separated. In these conventional systems, suction is drawn through a porous slip-sheet to secure an underlying printing plate. Different slips-sheets can have different degrees of porosity that can affect the picking reliability of the underlying plate.

Once a slip-sheet has been secured and separated from a printing plate, its reliable disposal presents additional challenges for automated media handling systems. Specifically, in a device designed to have a large number of printing plates on-line at any one time, the slip-sheets that are removed each time a plate is picked must be accumulated somewhere for disposal. Conventional plate-making systems have employed complex media handling mechanisms that remove and convey slip-sheets to containers such as slip-sheet holders. The reliability and throughput of the media handling system may be adversely affected when a picked slip-sheet must be additionally conveyed and deposited into a slip-sheet holder. Further, when slip-sheets are crumpled during the act of picking, separating, conveying or depositing them into a slip-sheet holder, the slip-sheets can occupy a significant volume that increases the size of the slip-sheet holder, thus adversely impacting the required footprint of the plate-making system.

The presence of slip-sheets can hinder automation associated with the processing of image recordable materials. Consequently, there remains a need for better methods and apparatus for storing slip-sheets removed from a media stack made up of an arrangement of image recordable materials and slip-sheets.

SUMMARY OF THE INVENTION

The present invention provides a method and apparatus for storing a slip-sheet removed from a stack of interleaved slip-sheets and printing plates and relates to image recording systems such as, for example, computer-to-plate (CTP) systems. Image recording systems include imaging systems that image an image recordable material in response to imaging information. Image recordable materials can include, for example, printing plates. Image recording systems can include integrated systems that additionally process the image forming materials. Additional processing can include, but is not limited to materials punching, materials bending, exposure to non-imaging radiation, chemical development and materials drying. The present invention relates to a materials handling system that separates a slip-sheet from a media stack that includes image recordable materials. A slip-sheet separates each of the image recordable materials from one another in the media stack. The image recordable materials removed from the stack are subsequently imaged and optionally additionally processed. The slip-sheets removed from the stack are moved to a position away from the media stack where they are stored in a slip-sheet holder that is moved to a position in the vicinity of the moved slip-sheets In one embodiment, the present invention includes a method for storing a slip-sheet, the method comprising: removing the slip-sheet from a media stack at a first position, the media stack including one or more slip sheets and one or more image recordable materials; moving the slip-sheet from the first position to a second position; moving a slip-sheet holder from a third position to a fourth position in which the slip-sheet holder positioned at the fourth position is in the vicinity of the slip-sheet positioned at the second position, and depositing the slip-sheet into the slip-sheet holder positioned at the fourth position.

In another embodiment, the present invention includes an apparatus for storing a slip-sheet, comprising: a media holder for supporting a media stack that includes the slip-sheet located at a first position, the media stack including one or more slip-sheets and one or more image recordable materials; a picker for securing the slip-sheet at the first position and moving the slip-sheet to a second position; and a slip-sheet holder for depositing the slip sheet into after the slip-sheet holder is moved from a third position to a fourth position in which the slip-sheet holder positioned at the fourth position is in the vicinity of the slip-sheet positioned at the second position.

BRIEF DESCRIPTION OF THE DRAWINGS

In drawing which show non-limiting example embodiments of the invention.

The features of this invention are shown in the accompanying figures. Although the figures are intended to illustrate this invention, they are not necessarily drawn to scale.

DETAILED DESCRIPTION OF THE INVENTION

Figure 1:
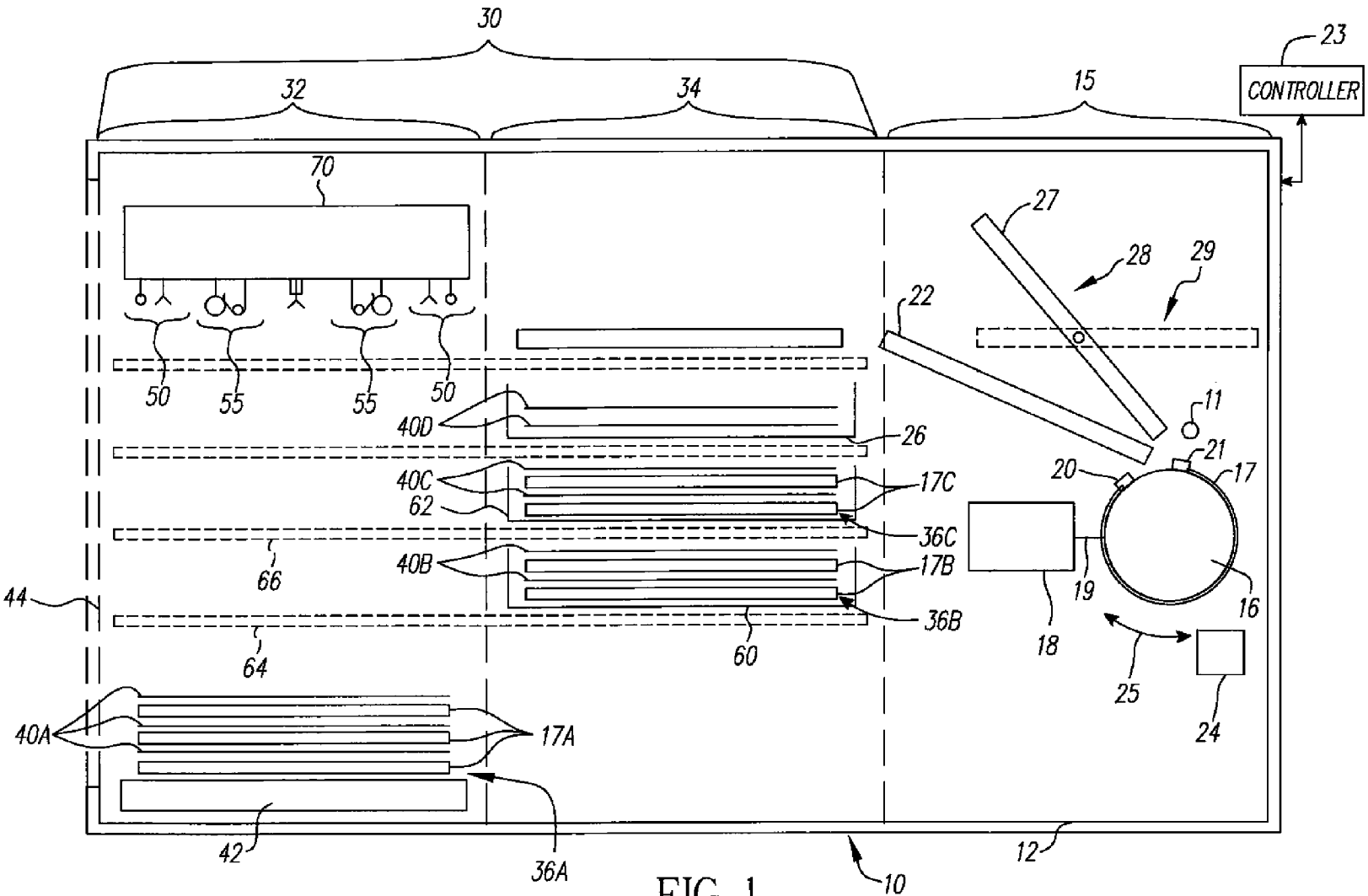
FIG. 1 schematically illustrates an example image recording system that includes an exposure system and a materials handling system.

FIG. 1 schematically shows an image recording system 10. The image recording system 10 includes an exposure system 15 and a materials handling system 30. In this embodiment, exposure system 15 and materials handling system 30 form an integrated system enclosed by housing 12.

Exposure system 15 includes an exposure support 16 to mount an image recordable material 17 thereupon and an imaging head 18 disposed to emit radiation beams 19 to form an image on the image recordable material 17. Materials handling system 30 includes, among other things, a picking assembly 70. Picking assembly 70 and image recordable materials picker 50 (herein referred to as "materials picker 50") secure and transport image recordable materials 17A, 17B, and 17C from one or more media stacks 36A, 36B, and 36C of image forming materials 17A, 17B, and 17C and transport the secured image recordable materials 17A, 17B, and 17C, respectively, to exposure system 15. Picking assembly 70 includes slip-sheet picker 55 to secure slip-sheets 40A, 40B, and 40C from one or more media stacks 36A, 36B, and 36C, respectively, and transport them to a slip-sheet holder 26. In this embodiment, materials pickers 50 and slip-sheet pickers 55 are combined to form an integrated picking assembly 70.

Exposure support 16 is an external cylindrical drum. Other types of exposure supports such as, for example, internal drums and flatbed configurations can be used. Image recordable material 17 is secured onto exposure support 16 by leading edge clamps 20 and trailing edge clamps 21. Image recordable material 17 is conveyed onto exposure support 16 with the assistance of loading support 22 and roller 11. During loading, exposure support 16 is appropriately positioned, and leading edge clamps 20 reactivated by an associated actuator (not shown) to accept image recordable material 17. Loading support 22 is used to support image recording material 17 as its leading edge is introduced into leading edge clamps 20. Image recordable material 17 is aligned with respect to exposure support 16 by abutting its leading edge against one or more registration features (not shown) that are positioned in a pre-determined orientation with respect to exposure support 16. Leading edge clamps 20 are activated to secure the leading edge of image recordable material 17 with respect to exposure support 16. Exposure support 16 is rotated to wrap image recordable material 17 on exposure support 16. Roller 11 is activated to ensure contact between image recordable material 17 and exposure support 16 during the wrapping. Exposure support 16 is rotated to a predetermined position wherein trailing edge clamps 21 are activated by an associated actuator (not shown) to secure the trailing edge of image recordable material 17 against exposure support 16. Other known systems for mounting image recordable material 17 onto exposure support 16 can also be used such as, for example, suction may be applied through various features formed on the surface of exposure support 16 to assist in securing image recordable material 17 to exposure support 16. Other known systems can be used to align image recordable material 17 with respect to exposure support 16.

Controller 23 is used to manage, create and/or modify digital files representing images to be formed on image recordable material 17. Controller 23 can also include a raster image processor to further process the digital files into image information that includes raster data. Controller 23 can provide device control signals to control the various required functions of exposure system 15 and materials handling system 30.

Image information and control signals provided by controller 23 are used to cause imaging head 18 to generate one or more radiation beams 19 to form an image on image recordable material 17. In this embodiment, exposure support 16 is rotated by drive 24 during imaging. Imaging head 18 can image a swath of data during each rotation. Drive 24 can rotate exposure support 16 clockwise or counterclockwise as required along a main-scan direction 25. Imaging head 18 is mounted onto a carriage (not shown) that moves along sub-scan direction that is substantially parallel with an axis of rotation of exposure support 16. Imaging head 18 can move along the sub-scan direction while exposure support 16 moves along main-scan direction 25 to create imaged swaths that are helical in form. Alternatively, the motion of imaging head 18 and exposure support 16 can be controlled to image "ring-like" swaths. This invention is not limited to this exposure system and other exposure systems that employ different control systems and schemes can be used.

When an image has been formed on image recordable material 17, image recordable material 17 is unloaded onto unloading support 27. Image recordable material 17 is unloaded from exposure support 16 by employing the steps of the media loading procedure described above but substantially in reverse sequence, and by correctly positioning exposure support 16 to unload image recordable material 17 onto unloading support 27. Unloading support 27 is movable from a first position 28, at which the image recordable media is unloaded to a second position 29 (shown in ghosted lines). At second position 29, the unloaded image recordable material 17 can be additionally processed, or conveyed for additional processing.

Materials handling system 30 includes a primary media supply 32 and a secondary media supply 34. Materials handling system 30 picks materials from a plurality of media stacks 36A, 36B and 36C. Media stack 36A can be stored within primary media supply 32. Media stack 36A includes one or more image forming materials 17A with one or more slip-sheets 40A. Interspersed between each of the image forming materials 17A is a slip-sheet 40A. It is to be noted that media stacks 36A, 36B and 36C show separations between image recordable materials 17A, 17B, and 17C and slip sheets 40A, 40B and 40C. These separations are shown for the sake of clarity, and those skilled in the art will realize that contact between the various sheets is typically present within the media stacks 36A, 36B and 36C.

In this embodiment, image recording materials 17A and slip-sheets 40A are stacked alternately and a slip-sheet 40A is positioned on top of media stack 36A. Media stack 36A can include a plurality of media stacks wherein each media stack contains one or more of image recordable material 17A and slip-sheet 40A. Media stack 36A is supported by media holder 42. Media holder 42 can include any suitable support system for media stack 36A, including, but not limited to, cassettes, magazines, or pallets. Pallets are particularly beneficial when media stack 36A includes a large number of image recording materials 17A such as, for example, aluminum offset printing plates. For instance, newspaper printing applications typically have high printing plate making demands. Consequently, a large uninterrupted supply of a large number of printing plates can be needed. Many plates weighing hundreds of kilograms can be required. Pallets provide a suitable means to support such quantities.

Media stack 36A is transported into primary media supply 32 via access port 44 by a cart, pallet-jack, forklift or the like. Access port 44 is closable by one or more covers (not shown). In this embodiment, media stack 36A remains stationary in primary media supply 32 when image recordable materials 17A and slip-sheets 40A are removed from media stack 36A. Media stack 36A remains stationary in primary media supply 32 when image recordable materials 17B and 17C and slip-sheets 40B and 40C are removed from media stacks 36B and 36C, respectively. A stationary media stack is particularly advantageous when the stack is high due to a large numbers of image recordable materials. Moving media holder 42 into an imaging position (or other positions) can cause an associated stack of media to shift due to accelerations/decelerations associated with the movement. A shifted media stack can lead to picking errors.

Secondary media supply 34 includes a media holder 60 and 62. Other embodiments of this invention can employ a different number of media holders. Media holder 60 contains media stack 36B that includes one or more of image recordable material 17B stacked one upon the other and media holder 62 contains media stack 36C that includes one or more of image recordable materials 17C stacked one upon the other. Interspersed between each of the image recording materials 17B and 17C are corresponding slip-sheets 40B and 40C, respectively. In this embodiment of the invention, image recordable materials 17B and 17C and slip-sheets 40B and 40C in each of media stack 36B and 36C, respectively, are stacked alternately and a slip-sheet is positioned on top of each of the stacks 36B and 36C. Each of media stacks 36B and media stacks 36C can include a plurality of image recordable material 17B and 17C and slip-sheets 40B and 40C. Each of media stacks 36B and media stacks 36C can include a plurality of media stacks.

Media holders 42, 60 and 62 can hold materials with similar or dissimilar characteristics. Material differences can include differences in size and/or composition. Differences in the image recordable materials 17A, 17B and 17C may be required by different print jobs. Alternatively, plate-making delays can be avoided by creating additional capacity by arranging one or more of the media holders 42, 60 and 62 to contain image recordable materials 17A, 17B and 17C, respectively, with the same characteristics as those contained in an additional media holder.

In this embodiment, as seen in FIG. 1, media holder 42 is arranged so that media stack 36A is continuously available to have materials removed from it. Media holder 42 assumes both a storage position and a materials removal position within primary media supply 32. Guides 64 and 66 allow media holders 60 and 62 to be moved from a storage position within secondary media supply 34 to a materials removal position within primary media supply 32. For example, when controller 23 determines that image recordable material 17B is required for a plate making operation, controller 23 sends a signal to a drive mechanism (not shown) associated with media holder 60. The drive mechanism causes media holder 60 to move from secondary media supply 34 along guides 64 into primary media supply 32. The drive mechanism can, for example, include an electrical motor, pulleys and/or timing belts. Those skilled in the art will appreciate that in other embodiments, the drive mechanism may comprise components such as, for example, pneumatic or hydraulic cylinders, chains, gears and other suitable prime movers. When media holder 60 is positioned in primary media supply 32, picking assembly 70 can remove slip-sheets 40B and image recordable materials 17B from media holder 60. In this illustrated example embodiment, controller 23 provides signals to ensure that when slip-sheets 40B and image recordable materials 17B are to be removed from media holder 60 positioned within primary media supply 32, an additional media holder will not be positioned above media holder 60 within primary media supply 32. An additional media holder positioned above a given media holder within primary media supply 32 can obstruct materials pickers 50 and slip-sheet pickers 55 from removing materials from the given media holder.

In this embodiment, controller 23 can provide and receive signals to allow an additional media holder to be positioned below a given media holder within primary media supply 32, such that slip-sheets and image recordable materials can be removed from the given media holder. An additional media holder positioned below a given media holder within primary media supply 32 does not obstruct picking assembly 70 from removing materials from the given media holder.

Figure 2:
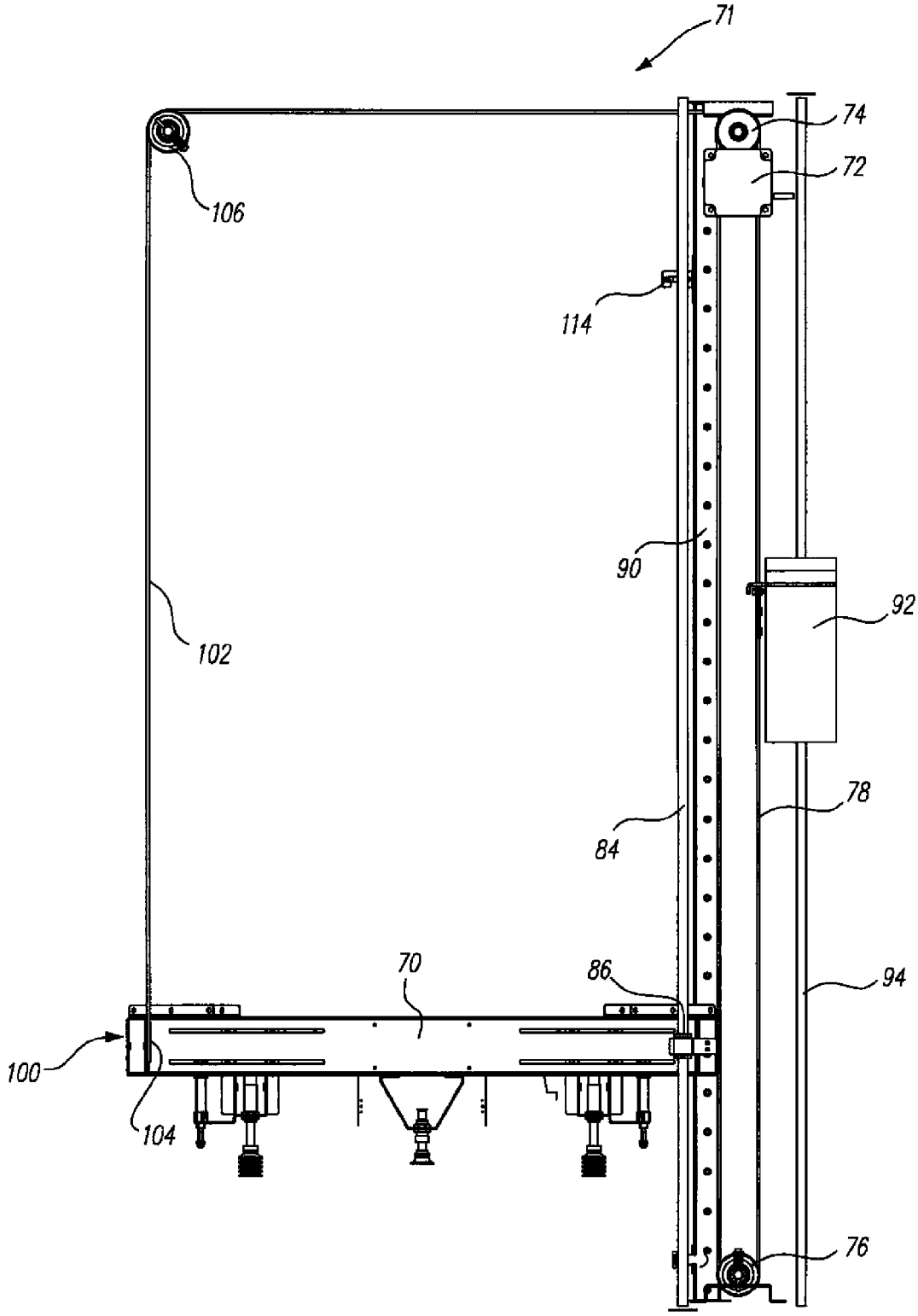
FIG. 2 shows a side view of a picking assembly used to secure and remove materials from a media stack.
Figure 3:
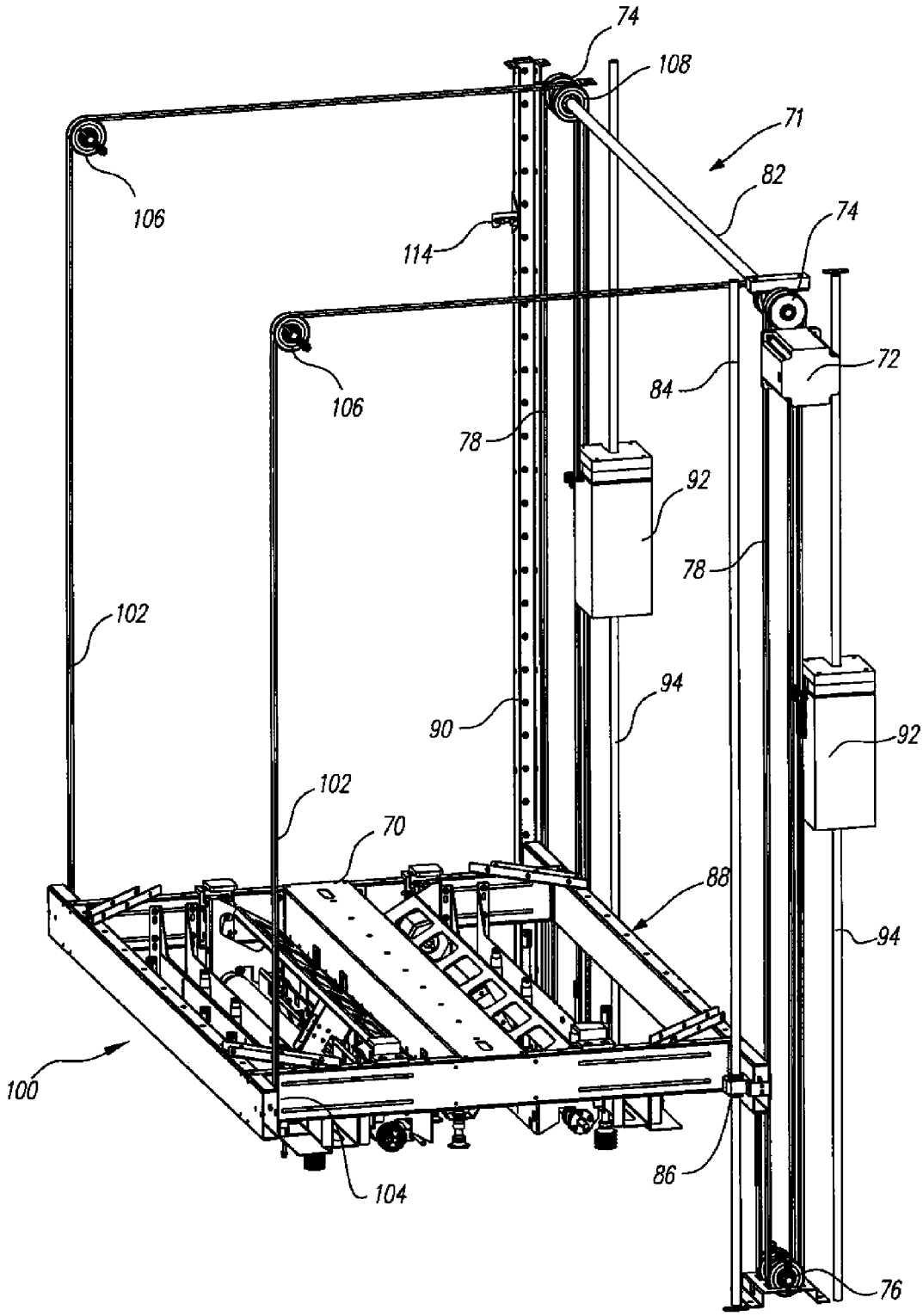
FIG. 3 shows a downward facing perspective view of the picking assembly shown in FIG. 2.
Figure 4:
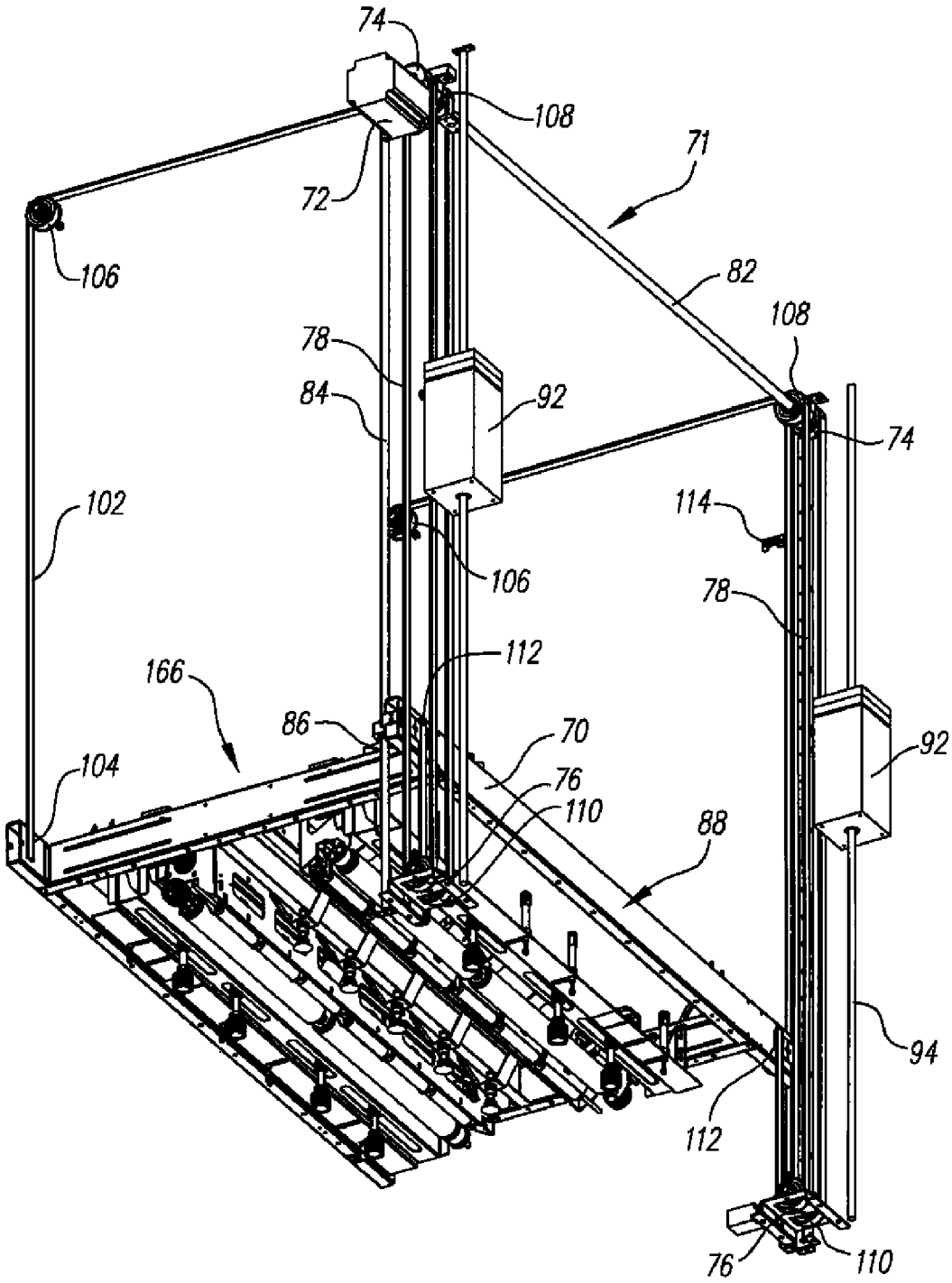
FIG. 4 shows an upward facing perspective view of the picking assembly shown in FIG. 2.

FIG. 2 shows a detailed side view of picking assembly 70 as per an embodiment of the present invention. FIG. 3 shows a downward facing perspective view of the picking assembly 70 shown in FIG. 2. FIG. 4 shows an upward facing perspective view of the picking assembly 70 shown in FIG. 2. When employed with a plurality of media holders such as media holders 42, 60 and 62 shown in FIG. 1, picking assembly 70 requires a vertical drive system 71 capable of facilitating materials removals at different heights. Referring to FIGS. 2, 3, and 4, vertical drive system 71 includes an electrical motor 72, drive pulleys 74, driven pulleys 76 and timing belts 78. Drive pulleys 74 are synchronized and are connected by drive shaft 82. Motor 72 can employ a gearbox (not shown) to rotate drive pulleys 74. Motor 72 can, for example, be a stepper motor. An encoder (not shown) can provide positional feedback associated with motor 72. Picking assembly 70 is guided along its motion by linear rail 84 and linear bearing 86 along first side and a roller (not shown) and channel 90 along a second side. The roller and channel 90 are employed to avoid over-constraining the motion of picking assembly 70 which could lead to binding of linear bearing 86 on linear rail 84.

Picking assembly 70 is mounted in a cantilevered orientation with respect to linear rail 84 and channel 90. Timing belts 78 effectively form a loop around drive pulleys 74 and driven pulleys 76. Drive side 88 of picking assembly 70 is mechanically coupled to a first side of the loop formed by timing belts 78. The weight of picking assembly 70 is counterbalanced by weights 92 which are mechanically coupled to a second side of the loop formed by timing belts 78. Weights 92 are additionally guided by linear rails 94. Weights 92 have a combined mass that is substantially equal to the mass of picking assembly 70 so that the burden of gravitational forces on picking assembly 70 are effectively removed from vertical drive system 71.

Non-drive side 100 of picking assembly 70 is additionally supported by timing belts 102. Timing belts 102 are attached to a first attachment point 104 on picking assembly 70, and then follow a path around idler pulleys 106, 108 and 110 and are additionally attached to second attachment point 112 on picking assembly 70. Timing belts 102 are appropriately tensioned to support the cantilevered end of picking assembly 70. Other example embodiments of this invention can employ other support mechanisms for the cantilevered end of picking assembly 70. Other embodiments of this invention can also employ any other suitable guide and support systems for picking assembly 70. For example, each of at least two sides of picking assembly 70 may be guided and supported by a linear rail and open channel as previously described with respect to drive side 84.

Sensor 114 determines when a picking assembly is located at a home position. Picking assembly 70 can also include various distance measurement devices (not shown) that can be employed to verify a position of a corresponding stack media positioned within primary media supply 32. Distance measurement devices can be employed to verify the position of one media holders 60 and 62 moved into primary media supply 32. Examples of distance measurement devices include ultrasonic sensors, lvdt stroke sensors, IR beam distance measurement devices, and inductance sensing devices. Distance measurement devices can be mounted to picking assembly 70.

Figure 5:
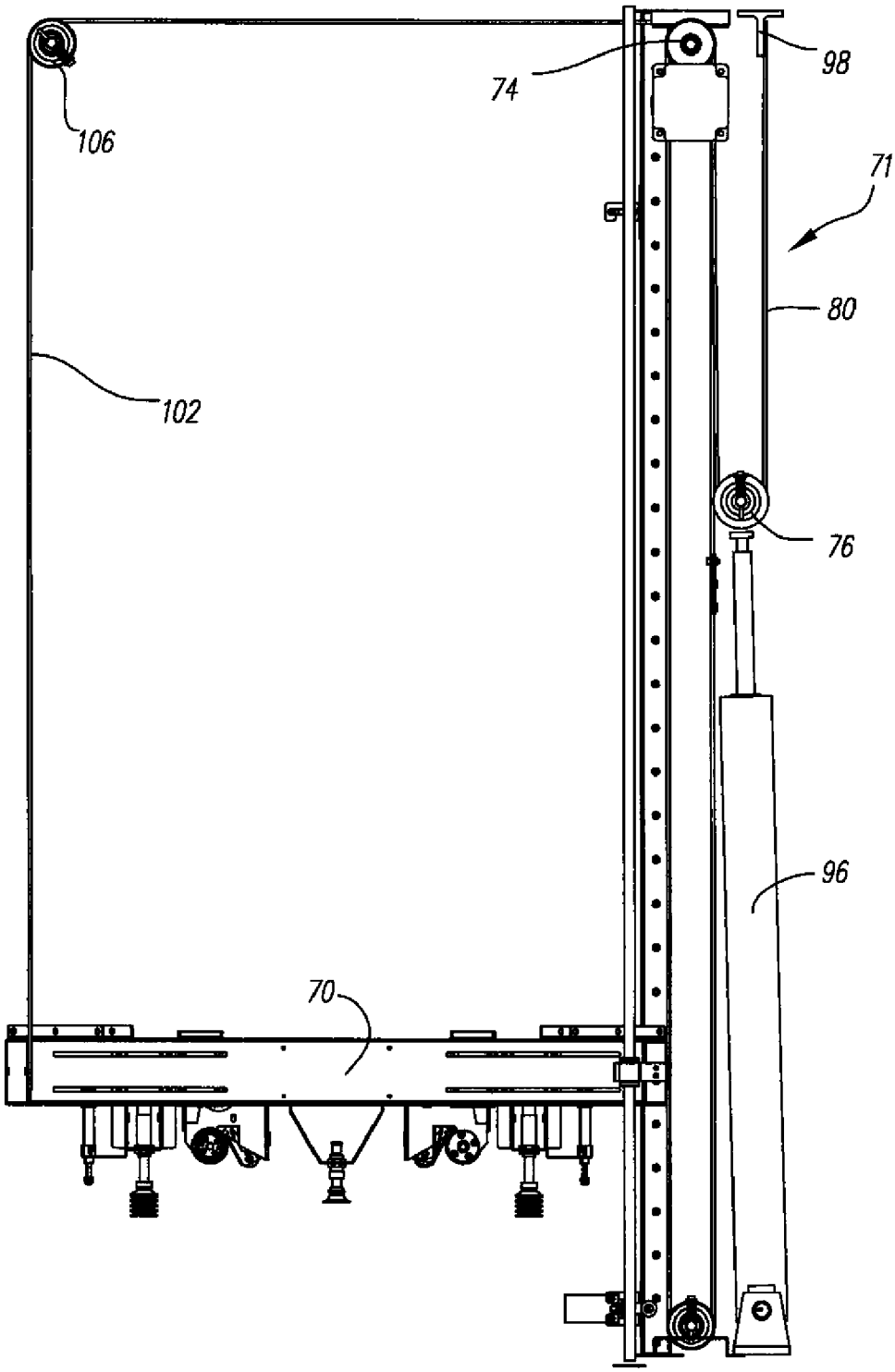
FIG. 5 shows a side view of a picking assembly used to secure and remove materials from a media stack, wherein the picking assembly is counterbalanced with the use of fluid cylinders.

FIG. 5 shows side view of a vertical drive system 71 employed by the present invention. Here, weights 92 (as seen in FIGS. 2, 3, and 4) are replaced by fluid actuators 96. For the sake of clarity, only one fluid actuator 96 is shown. Fluid actuators 96 are pneumatic cylinders fed by a controllable gaseous source (not shown) such as compressed air supply. The compressibility characteristics of gases allows for some degree of compliance within the system. Driven pulleys 76 are fixed to the rod ends of fluid actuators 96. Each timing belt 80 is arranged in a serpentine fashion that originates from an attachment point on picking assembly 70, wraps around drive pulley 74 and driven pulley 76 and terminates at a fixed point 98. The gas supply is controlled so that each fluid actuator 96 applies an appropriate force to associated driven pulleys 76 sufficient to offset the weight of picking assembly 70. The gas supply can be additionally actively controlled to "boost" upward and/or downward motions of picking assembly 70 throughout a portion or all of its motion. Those skilled in the art will realize that alternative vertical drive systems can be employed by other example embodiments of this invention.

Figure 6:
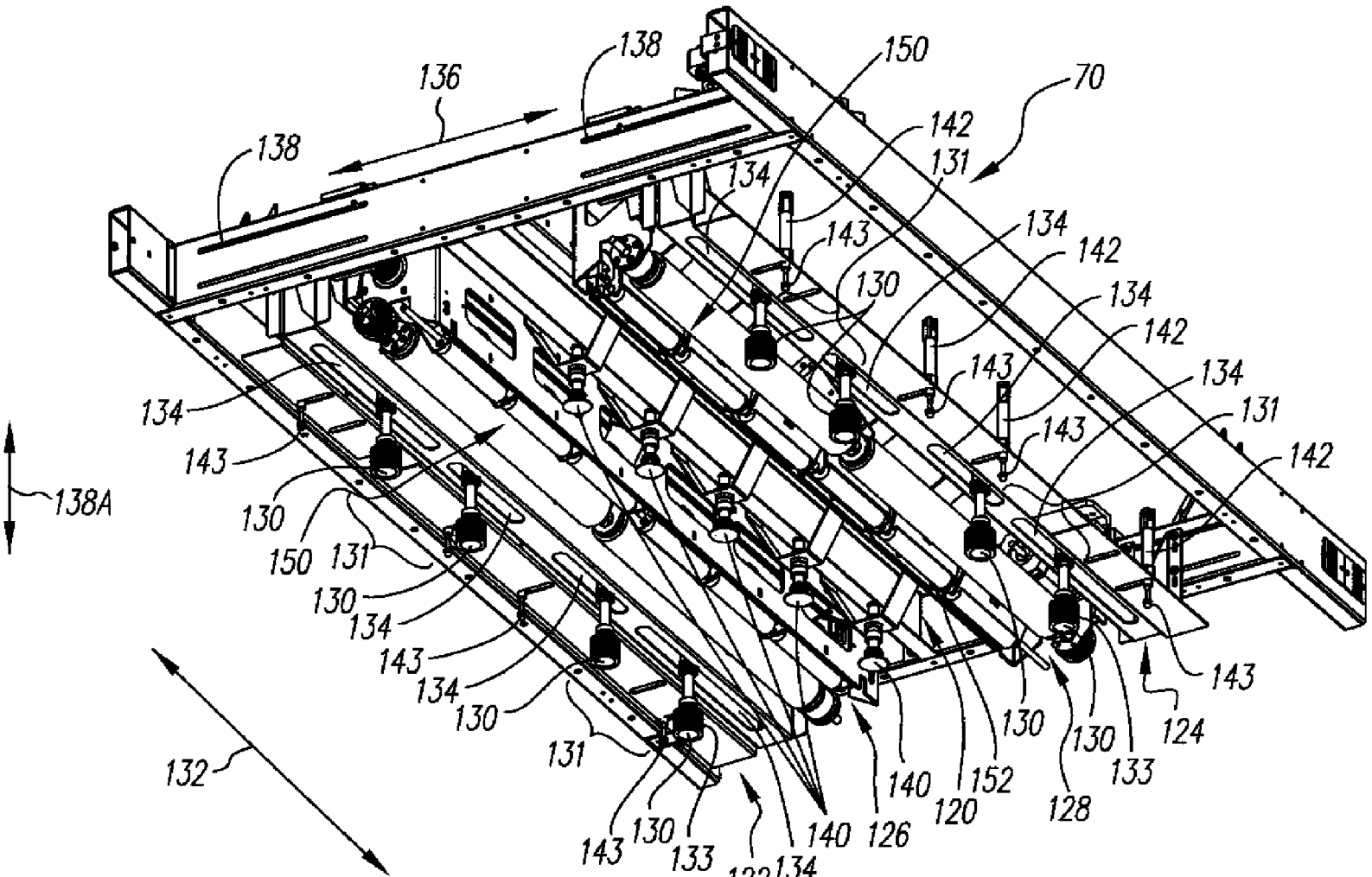
FIG. 6 shows an enlarged upward facing perspective view of the picking assembly shown in FIG. 2.

FIG. 6 shows an enlarged upward facing perspective view of picking assembly 70. For the sake of clarity, other components shown in FIGS. 2, 3 and 4 are not shown. Picking assembly 70 comprises a media pinning mechanism 120, image recordable material pickers 122 and 124 (herein referred to as "pickers" 122 and 124) and slip-sheet pickers 126 and 128. In this embodiment, pickers 122 and 124 are used to pick image recordable materials 17A, 17B, and 17C from a media stack 36A, 36B, and 36C, when positioned within primary media supply 32. Each of pickers 122 and 124 is arranged to grip separate portions of an image recording material 17A, 17B, or 17C and each portion can include, or is adjacent to, an edge of the image recordable material 17A, 17B, or 17C (not shown in FIG. 6). The portions can include opposing edges of the image recordable material 17A, 17B, or 17C.

In this embodiment, each of the pickers 122 and 124 includes one or more suction mechanisms 130 to grip image recordable material 17A, 17B, or 17C. Other embodiments of this invention can employ other types of gripping mechanisms. Suction mechanism 130 can secure itself to a surface of an image recordable material 17A, 17B, or 17C by suction. Suction can be generated by numerous methods and will be dependant upon the suction mechanism employed. For example, when suction mechanism 130 includes a suction cup, a fluid comprising a negative fluid pressure (i.e. with respect to atmospheric pressure) can be supplied to suction mechanism 130 to generate the required suction. Alternatively, suction can be generated by a flow of fluid between the pickup face of a surface of suction mechanism 130 and the surface of the image recordable material 17A, 17B, or 17C as taught in U.S. Pat. No. 6,601,888 which is herein incorporated by reference. In this embodiment, the fluid is made to flow with a velocity sufficient to produce a pressure differential between the flowing fluid and a surrounding fluid medium. Bernoulli lift is generated to provide suction. Suction mechanism 130 may be in contact with a surface of the image recordable material 17A, 17B, or 17C when image recordable material 17A, 17B, or 17C is gripped. "Contactless" securement is advantageous when the picked surface of the image recordable material 17A, 17B, or 17C includes a modifiable surface that may be damaged if directly handled.

In this embodiment, two groups 131 made up of two suction mechanisms 130 each are employed in each of the pickers 122 and 124, respectively. In other embodiments, a different number of suction mechanisms 130 can be employed. Multiple groups of suction mechanisms 130 can be employed when a plurality of image recordable materials 17A, 17B, or 17C are simultaneously picked from a corresponding plurality of media stacks 36A, 36B, and 36C. In this illustrated embodiment, each suction mechanism 130 in each group 131 is movable along directions 132 in slots 134. This allows image recordable materials 17A, 17B, and 17C with different size attributes along directions 132 to be gripped or secured. Suctions mechanisms 130 can also be moved along directions 136 by a corresponding movement of either picker 122 and 124 along slots 138. This allows image recordable materials 17A, 17B, and 17C with different size attributes along directions 136 to be gripped or secured. In this illustrated embodiment, suction mechanisms 130 can be manually positioned along directions 132 and 136 and can be secured by any suitable fastener when they have been properly located. In other example embodiments of this invention, controller 23 can be employed to control various actuators to position suction mechanisms 130 along one, or both of directions 132 and 136. Such actuators are well known in the art, and can include, but are not limited to, electric motors and transmission members such as gears, pulleys, screws, belts and chains.

Each suction mechanism 130 can also include a compliance member 133. Compliance member 133 can include any suitable spring element or other elastic member. In this illustrated embodiment, compliance member 133 includes a bellows in each suction mechanism 130. Compliance along directions 138A can reduce the positional accuracy requirements of the vertical drive system 71 when suctions mechanisms 130 are positioned with respect to the image recordable materials 17A, 17B, or 17C.

Controller 23 can be used to control the suction produced at each suction mechanism 130 by controlling each suction mechanism 130 individually or as part of a group 131. A selectable suction control can be used to grip different sizes of image recordable materials 17A, 17B, or 17C or different numbers of image recordable materials 17A, 17B, or 17C.

Pinning mechanism 120 includes one or more pinning members 140 that bear against an uppermost sheet of a media stack, for example, media stack 36A in FIG. 1 (not shown). The uppermost sheet can be a slip-sheet 40A, 40B, or 40C or an image recordable material 17A, 17B, or 17C. Pinning the uppermost sheet against the underlying media stack 36A, 36B, or 36C can help reduce shifting of the media stack 36A, 36B, and 36C during subsequent securing of slip-sheet 40A, 40B, or 40C and image recordable materials 17A, 17B, or 17C.

Pinning members 140 can be compliant along directions 138A. Compliance can reduce the positional accuracy requirements of the vertical drive system 71. Pinning members 140 can be used to change the shape of an uppermost sheet when it is separated from the top of media stack 36A, 36B, or 36C. Changing the shape of the uppermost sheet can include bending the uppermost sheet. Pinning a central portion of an uppermost sheet can be used to increase the degree of curvature imparted on an uppermost sheet as it is separated from the underlying media stack.

Changing the shape of the uppermost sheet can be used to assist in separating one more sheets adhered to the bottom of the uppermost sheet as it is separated from the media stack. Sheets may adhere to one another as a result of various causes including, but not limited to, static electricity and/or the creation of vacuum between sheets.

Pining members 140 can be constructed from materials that can reduce potential damage to a modifiable surface. The actuation and/or physical shape of pinning members 140 can be controlled to reduce potential damage to a modifiable surface of an image recordable material 17A, 17B, or 17C. In this embodiment, pinning members 140 include suction members that are controlled to grip at least the uppermost sheet. Separation of at least the uppermost sheet can be assisted by gripping. Gripping can be used to change the shape of at least the uppermost sheet.

Each of pickers 122 and 124 include flexing members 142. Flexing members 142 comprise a plunger 143 that is extendible and retractable in directions that are preferably parallel to directions 138A. In other example embodiments of this invention, plunger 143 may extend and retract at some predetermined angle with respect to directions 138A, but care should be taken to regulate motion that is tangential to a secured surface of the image recordable material to minimize potential damage to its modifiable surface. Plungers 143 can be driven by any suitable actuators and such actuators can be controlled by controller 23. Spring biased or double acting pneumatic actuators and the like are examples of suitable actuators.

Picking assembly 70 comprises slip-sheet pickers 126 and 128. In this illustrated example, slip-sheet pickers 126 and 128 are used to pick slip-sheets 40A, 40B, and 40C from a media stack 36A, 36B, and 36C, respectively. Each of slip-sheet pickers 126 and 128 are arranged to pick separate portions of a slip-sheet 40A, 40B, or 40C and each portion can include, or be adjacent to, an edge of slip-sheet 40A, 40B, or 40C. Slip-sheet 40A, 40B, and 40C portions can include opposing edges of the slip-sheet 40A, 40B, and 40C. FIGS. 7A, 7B, 7C and 7D schematically show different views of picker 144, which is similar to picking assembly 70 but with one set of gripping members 130A and one set of flexing members 142A for practicing a method of securing and separating a portion of image recordable material 17E(1), which is similar to 17A, 17B, 17C, and 17E, from media stack 36E, which is similar to media stack 36A, 36B and 36C, respectively. Media stack 36E includes a plurality of image recordable materials 17E and 17E(1). A slip-sheet 40E, which is similar to 40A, 40B and 40C, separates each of the image recordable materials 17E and 17E(1) in media stack 36E. As shown in plan view in FIG. 7A, picker 144 includes two gripping members 130A and two flexing members 142A which are used to grip and separate image recordable material 17E(1) from media stack 36E. The number of gripping members 130A and flexing members 142A is not necessarily limited to two, and other numbers of gripping members 130A and/or flexing member 142A are within the scope of this invention. In this illustrated example embodiment, gripping members 130A comprise two suction mechanisms that are aligned along an axis A-A.

Figure 7A:
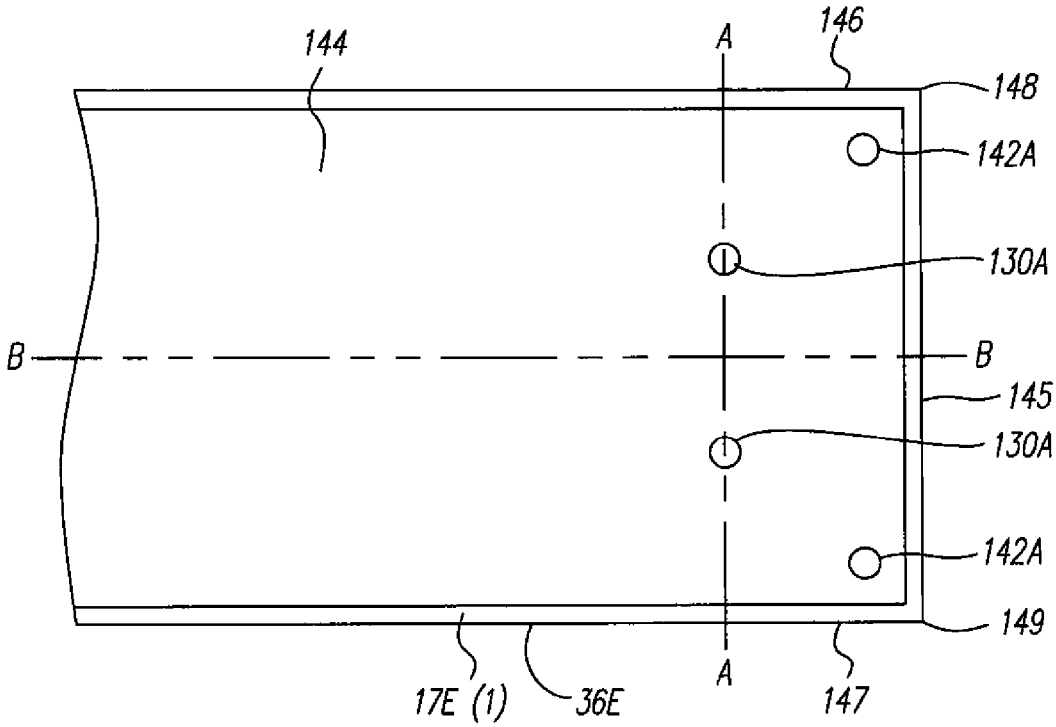
FIGS. 7A-7D schematically illustrate different views of an apparatus for securing and separating a portion of an image recordable material from media stack.
Figure 7B:
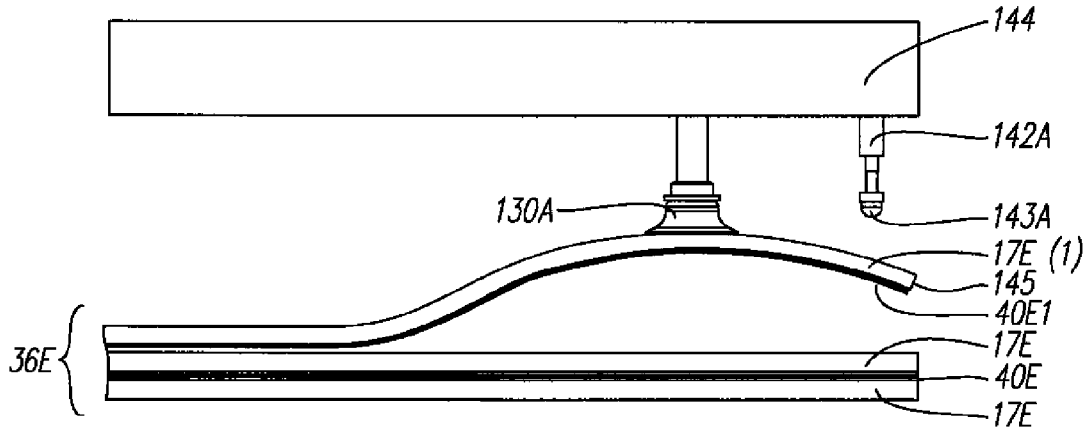

As shown in side view in FIG. 7B, gripping members 130A are positioned over a portion of an uppermost image recordable material 17E(1) that includes, or is adjacent to an edge 145 of image recordable material 17E(1). Typically, edge 145 is substantially parallel to axis A-A. Gripping members 130A are activated to grip and lift image recordable material 17E(1) from media stack 36E as shown in FIG. 7B. This lifting is also known as "wristing" and can involve bending the secured portion of image recordable material 17E(1) away from the underlying media stack about an axis substantially parallel to axis A-A. Lifting can involve bending the secured portion of image recordable material 17E(1) about and axis substantially parallel to edge 145.

Figure 7C:
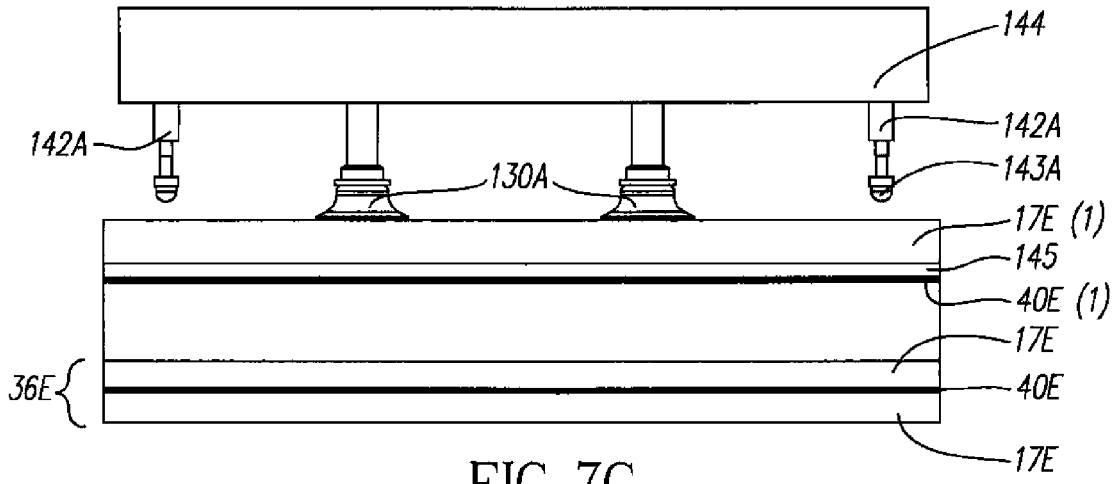

FIG. 7C shows an end view of image recordable material 17E(1) that has been lifted by gripping member 130A. Several potential problems can accompany the lifting of image recordable material 17E(1). One or more underlying slip-sheets 40E and/or image recordable materials 17E can adhere themselves to the secured image recordable material 17E(1) and be inadvertently conveyed with the image recordable material 17E(1) to a subsequent process. These additional materials can lead to undesired reliability problems. FIGS. 7B and 7C show an example of a "miss-pick" in which a slip-sheet 40E(1) has adhered itself to lifted image recordable material 17E(1).

Figure 7D:
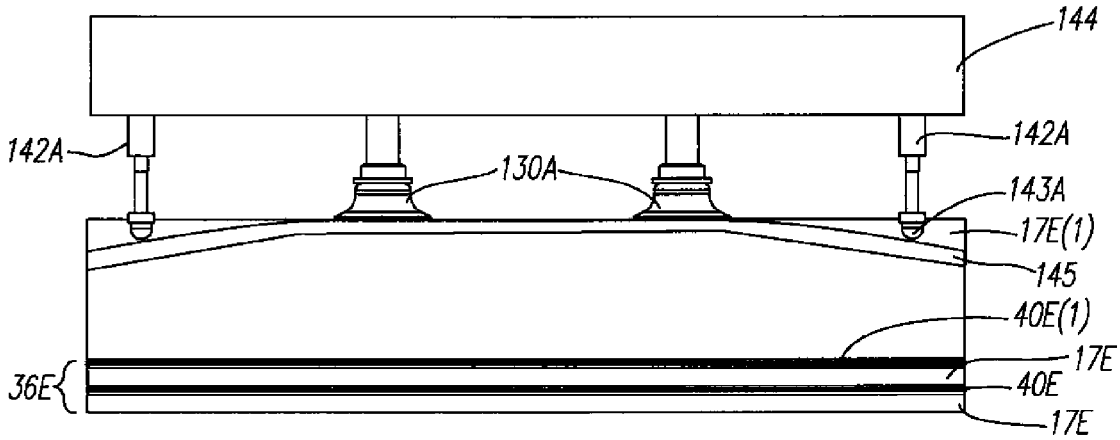

FIG. 7D shows an end view in which flexing members 142A are activated to separate slip-sheet 40E(1) such that it has fallen back onto stack 36E. Flexing members 142A are positioned over the portion of the image recordable material 17E(1) that has been lifted. As shown in FIGS. 7A and 7B, flexing members 142A are positioned between gripping members 130A and the edge 145. As shown in FIG. 7A, flexing members 142A are positioned between gripping members 130A and their respective adjacent side edges 146 and 147. Flexing member 142A can be positioned respectively over portions of image recordable material 17E(1) that includes, or is adjacent to corners 148 and 149 of image recordable material 17E(1). Flexing members 142A are activated to extend plungers 143A to bend image recordable material 17E(1) towards media stack 36E. In this example, flexing members 142A are activated to cause plungers 143A to extend and bend image recordable material 17E(1) along an axis substantially parallel to axis A-A. Flexing members 142A bend corners 148 and 149 to transversely bend image recordable material 17E(1). In this example, image recordable material 17E(1) is bent about axis B-B to create a compound curve. The action of flexing member 142A is effective in causing underlying attached material to separate from the secured image recordable material 17E(1), especially when a compound curve is formed in imaged recordable material 17E(1).

Unlike conventional separation methods that employ fixed separation features (e.g. separation plates fixed to a media holder) that need to separate an underlying sheet from a given sheet over limited amount of travel defined primarily by the distance between the given sheet within the media holder and the separation feature affixed to the media holder, the active nature of flexing members 142A can bend an image forming material 17E(1) (and adhered materials) over a large distance that is limited primarily by the distance the image recordable material 17E(1) is lifted above media stack 36E. The bending of image recordable material 17E(1) over a relatively large distance is effective in causing an additional adhered material to separate from the image recordable material 17E(1), especially when a compound curve is formed in imaged recordable material 17E(1).

Flexing members 142A can be controlled by controller 23, or the like to extend plungers 143A by different amounts to selectively bend a given image recordable material 17E(1) by a distance dependent upon a particular characteristic of the given image recordable material 17E(1). Different characteristics can include a size characteristic such as the thickness of the given image recordable material 17E(1) and/or a material characteristic such as elastic modulus and/or plastic deformations limits of the given image recordable material 17E(1). Unlike fixed separation features, flexing members 142A can be advantageously controlled to bend a number of different image recordable materials 17E(1) based upon on each of their particular characteristics, thus improving the reliability of the separation of any adhered materials.

Flexing members 142A can be controlled by controller 23, or the like to extend plungers 143A by different amounts to selectively bend a given image recordable material 17E(1) by a distance dependent upon a position of gripping members 130A and/or flexing members 142A relative to image recordable material 17E(1). Advantageously, this improves the reliability of the separation of any adhered materials when the position of gripping members 130A and/or flexing members 142A is required to vary between different image recordable materials. Flexing members 142A can be controlled by controller 23, or the like to extend plungers 143A by different amounts to selectively bend a given image recordable material 17E(1) by distance dependent upon existing environmental factors. Changes in environmental factors such humidity can change the degree of adherence between an underlying sheet and image recordable material 17E(1). Changes in these environmental factors can be measured by an appropriate sensor. These measured changes can be used by controller 23, or the like to control flexing members 142A in accordance with these changes.

Flexing members 142A can be controlled to repeatedly flex image recordable material 17E(1) to further assist with the separation of an adhered material. In some example embodiment of this invention, a plurality of flexing members 142A can be activated in tandem to flex corresponding portions of image recordable material 17E(1) at substantially the same time. In yet other example embodiments of this invention, a plurality of flexing members 142A can be sequentially activated to flex corresponding portions of image recordable material 17E(1) at different times. In other embodiments of this invention, flexing members 142A can include gripping mechanisms such as, but not limited to, suction members. Gripping mechanisms can allow flexing members 142A to push and pull corresponding portions of the image recordable material 17E(1) towards and away from media stack 36E to flex image recordable material 17E(1) over a greater range to promote the separation of an adhered media.

FIG. 7B shows that gripping members 130A have lifted image recordable material 17E(1) such that it does not contact flexing member members 142A. In other embodiments of the invention, gripping members 130A can lift image recordable material 17E(1) such that it contacts flexing member 142A prior to their movement. Initially contacting flexing member 142A can reduce the amount of extension required of plungers 143 to bend image recordable material 17E(1).

Figure 8:
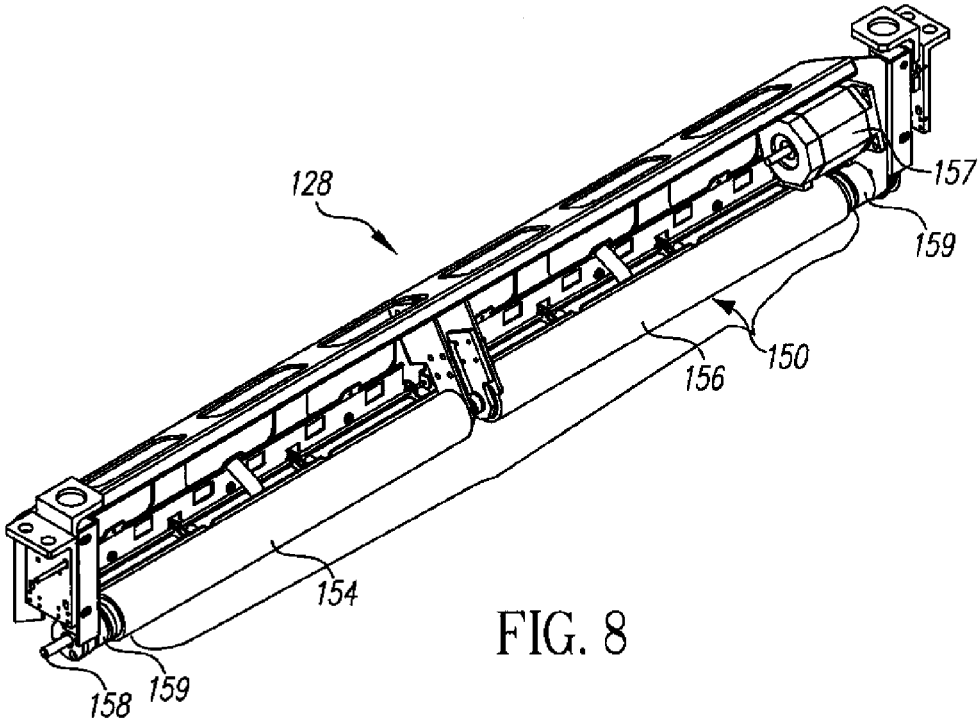
FIG. 8 illustrates a perspective view of slip-sheet picker used to secure a portion of a slip-sheet.

Each of slip-sheet pickers 126 and 128 includes a roller mechanism 150 and a nipping mechanism 152. FIG. 8 shows a perspective view of slip-sheet picker 128, which is similar to slip sheet picker 126. Here, roller mechanism 150 includes a plurality of rollers that includes retraction roller 154 and retraction roller 156. Each of retraction rollers 154 and 156 are supported on shaft 158 that is driven by electric motor 157. Motor 157 is controllable by controller 23 (not shown in FIG. 8) or the like and can drive shaft 158 directly or via a transmission element (e.g. timing belt chain, gear-head, etc.). Refraction rollers 154 and 156 are used to engage a slip-sheet 40A, 40B, and 40C located on the top of a media stack 36A, 36B, and 36C, respectively. Retraction rollers 154 and 156 are each coupled to shaft 158 by a corresponding clutch 159. Each of the clutches 159 is controlled by controller 23 which can be used to selectively drive each of refraction rollers 154 and 156. Additionally, each retraction roller 154 and 156 can be driven by its own electric motor and mounted on its own independent shaft so that retraction roller 154 and 156 operate independently. When any of media stacks 36A, 36B, and 36C are made up of a plurality of media stacks disposed on a corresponding media holder, selective driving of each of the retraction rollers 154 and 156 can allow slip-sheets to be selectively engaged from the top of a plurality of media stacks disposed on the same media holder. Each stack of the plurality of media stacks disposed on the same media holder can include slip-sheets with the same or different characteristics. Selective control of retraction rollers 154 and 156 can allow for the securement of different predetermined quantities of slip-sheets 40A, 40B, and 40C. Selective control of retraction rollers 154 and 156 can allow for the subsequent securement of one or more slip-sheets 40A, 40B, and 40C comprising a similar characteristic. It will be apparent to those skilled in the art that various numbers of retraction rollers can be employed by other embodiments of this invention and each retracting roller can be controlled by other methods, including but not limited to, controlling each retraction roller with a corresponding electric motor.

Figure 9:
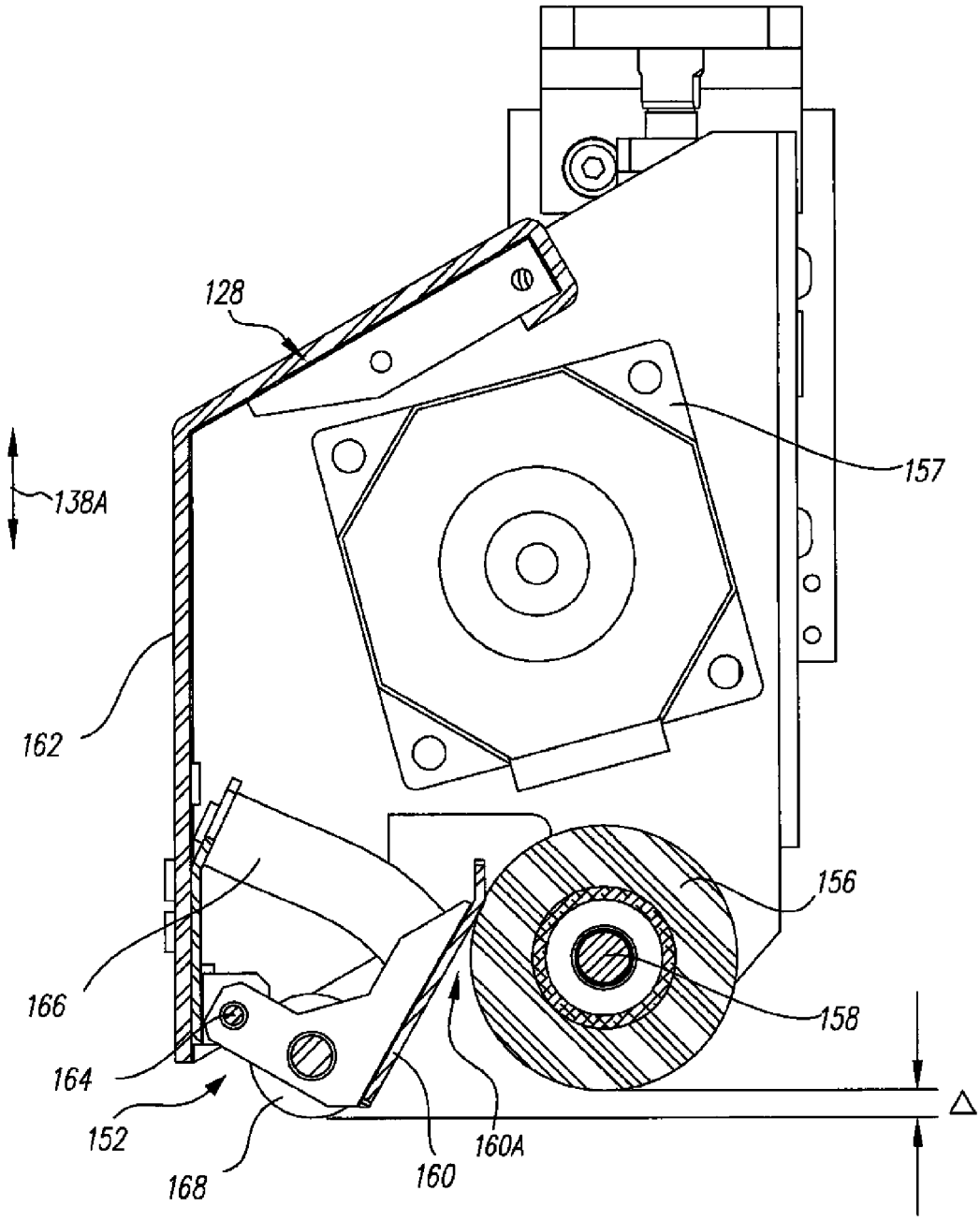
FIG. 9 illustrates a sectional view of the slip-sheet picker illustrated in FIG. 8.

FIG. 9 shows a cross-sectional view of slip-sheet picker 128, including retraction roller 156, a nipping mechanism 152, support 162 and motor 157. In this illustrated embodiment, motor 157 drives shaft 158 via a timing belt (not shown). Nipping mechanism 152 includes nipping member 160 that is pivotally attached to support 162 via pivot pin 164. Nipping member 160 is urged towards a surface of retraction roller 156 by biasing member 166. In this embodiment, biasing member 166 includes a compression spring. Nipping mechanism 152 further includes clamping roller 168 that is rotatably attached to nipping member 160. Clamping roller 168 is made from 60 durometer (Shore A) silicone. When nipping member 160 is urged towards refraction roller 156, a contact nip 160A is formed between the two, and a portion of the cylindrical surface of clamping roller 168 is disposed lower than a portion of the cylindrical surface of retraction roller 156 by a spacing Δ along direction 138A. If spacing Δ is reduced by, for instance, moving clamping roller 168 upwards, nipping member 160 rotates away from retraction roller 156 and the contact nip is not formed. Those skilled in the art will realize that other suitable actuators such as pneumatic or hydraulic cylinders can be used to selectively form a contact nip between nipping member 160 and retraction roller 156. Some actuators can be actively controlled by controller 23, or the like, to selectively form contact nip 160A.

Figure 10A:
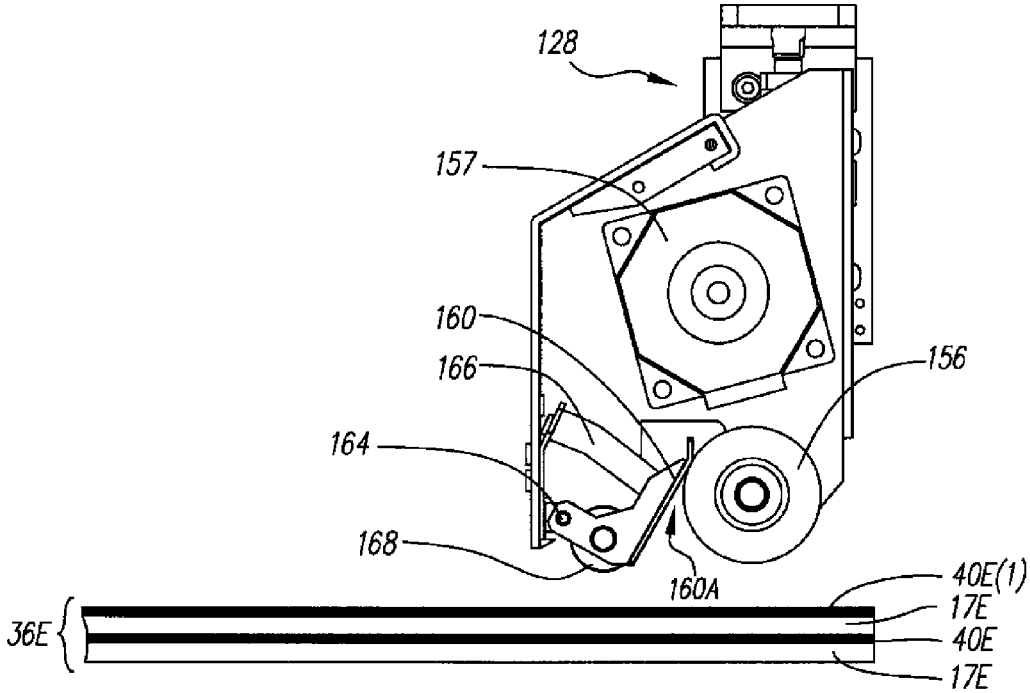
FIGS. 10A-10D schematically illustrates slip-sheet picker of FIG. 9 used in a sequence of steps to secure and separate a portion of an uppermost slip-sheet disposed on top of a media stack.
Figure 10B:
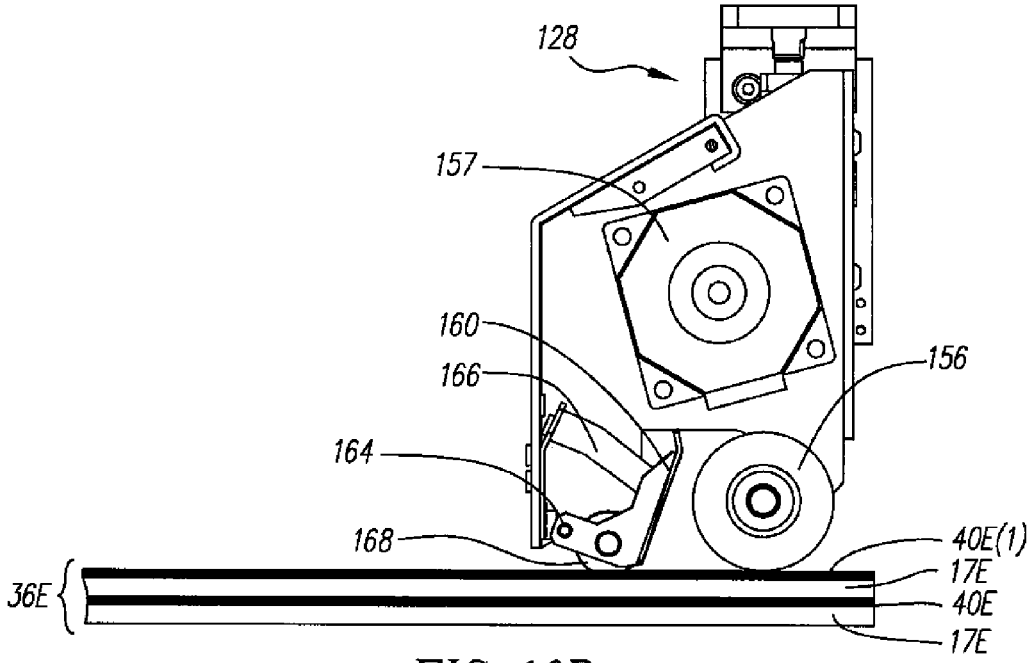

FIGS. 10A, 10B, 10C and 10D show a cross-sectional view of slip-sheet picker 128 used in a sequence of steps to secure and separate a portion of an uppermost slip-sheet 40E(1) disposed on top of a media stack 36E as per an example embodiment of this invention. Media stack 36E includes an interleaved plurality of image recordable materials 17E and slip-sheets 40E. Slip-sheet picker 128 is described for the purposes of illustration only, and it is to be understood that slip-sheet picker 126 can also work in a similar manner. In FIG. 10A, slip-sheet picker 128 is positioned above slip-sheet 40E(1). In this position nipping member 160 is urged towards retraction roller 156 to form a contacting nip 160A. In FIG. 10B, slip-sheet picker 128 is moved into contact with slips-sheet 40E(1). In this position, both retraction roller 156 and clamping roller 168 are moved into contact with slip-sheet 40E(1). As clamping roller 168 is brought into contact with slip-sheet 40E(1) nipping member 160 rotates away from retraction roller 156.

Figure 10C:
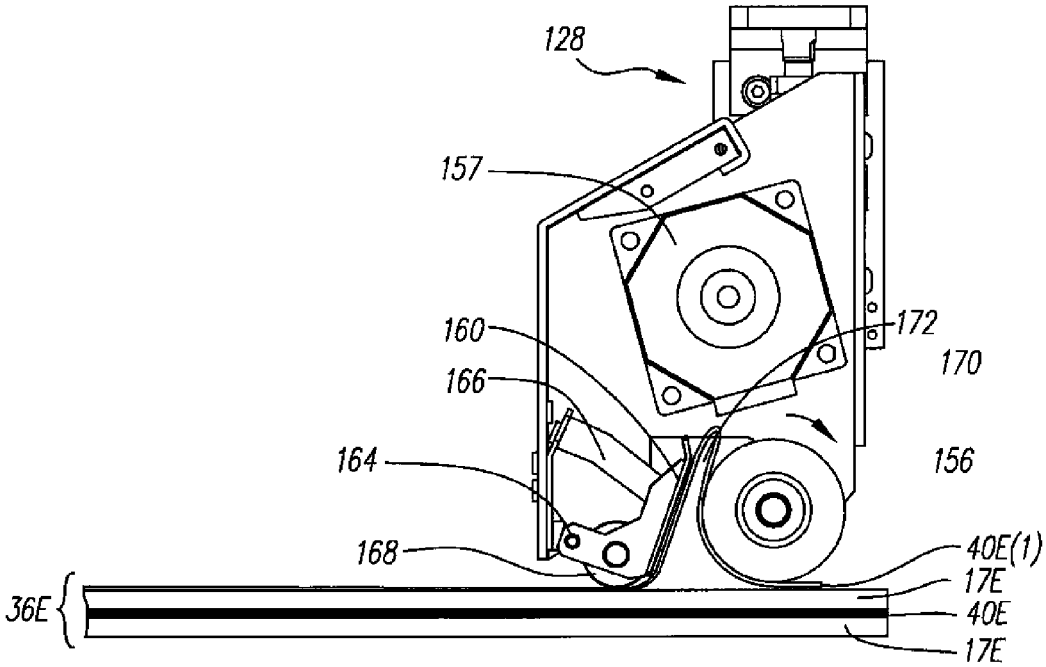

In FIG. 10C, retraction roller 156 is rotated in direction 170 by motor 157 and clutch 159 (not shown), both of which are controlled by controller 23 (not shown), or the like. Rotation of retraction roller 156 causes slip-sheet 40E(1) to laterally move with respect to the underlying media stack and buckle to form a loop 172 between nipping member 160 and retraction roller 156. In this illustrated embodiment, retraction roller 156 includes a 50 to 60 Shore A durometer polyurethane layer that frictionally engages slip-sheet 40E(1). When retraction roller 156 is rotated in direction 170, clamping roller 168 pins slip-sheet 40E(1) to the underlying media stack 36E to allow loop 172 to form.

Figure 10D:
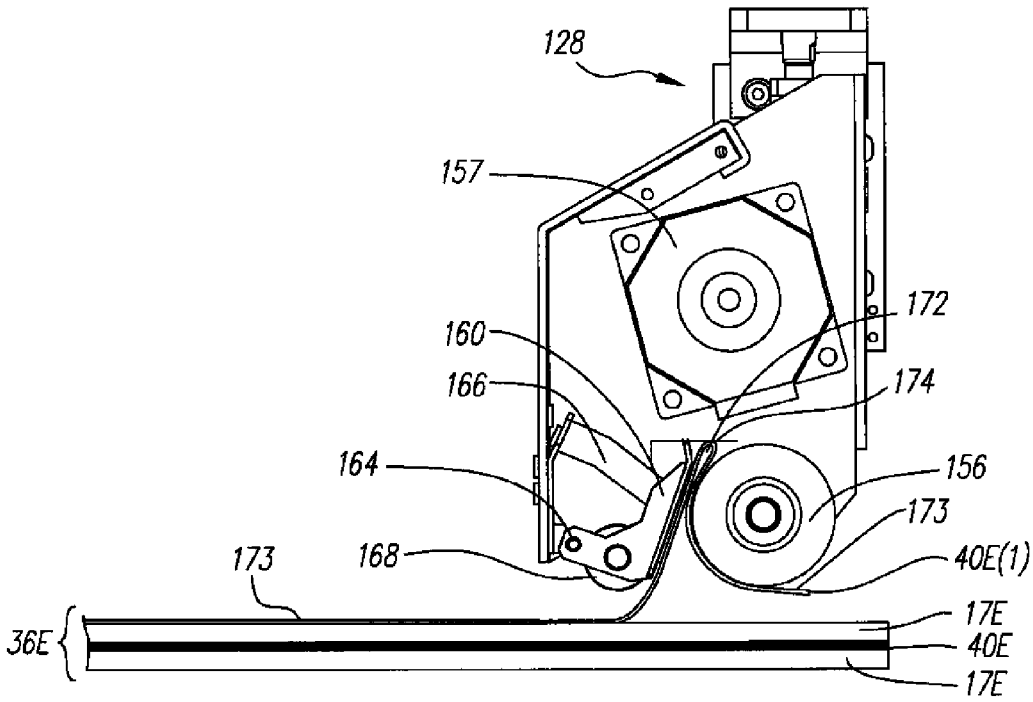

FIG. 10D shows the securing of the buckled slip-sheet 40E(1). Here, slip-sheet picker 128 has moved away from media stack 36E such that clamp roller 168 no longer contacts media stack 36E. In this state, biasing member 166 urges nipping member 160 to rotate towards retracting roller 156 to secure loop 172 in contact nip 160A. Nipping member 160 and retraction roller 156 each contact the same surface 173 of slip-sheet 40E(1) when it is secured in the contact nip 160A. Slip-sheet picker 128 can then be additionally further moved to further separate a secured slip-sheet 40E(1) from media stack 36E. Slip-sheet picker 128 can be moved to completely separate a secured slip-sheet 40E(1) from media stack 36E.

The position of slip-sheet picker 128 and the rotation of retraction roller 156 are controlled such that loop 172 is formed with sufficient length to avoid a crease or fold from forming in slip-sheet 40E(1) when it is captured in contact nip 160A between nipping member 160 and retraction roller 156. Creases or folds in slip-sheet 40E(1) are likely to occur when a contact nip is formed substantially at, or in the immediate vicinity of apex 174 of loop 172. In such cases, loop 172 is constrained to form a bend radius sufficiently small enough to form a crease or fold. Creases include folds where portion of the slip-sheet 40E(1) is folded upon itself. Creases can be created such that the folded portions of slip-sheet 40E(1) remain folded upon themselves or open to form V-shaped sections.

Picked slips-sheets 40E(1) that are creased can not typically be stored efficiently within a slip-sheet holder since the creases can prevent picked slip-sheets 40E from assuming a planar form that would allow an efficient stacking of picked slip-sheets 40E. Non-planar forms typically occupy more space, complicating storage requirements. Although it may be possible to nest successive creased slip-sheets 40E, this may place an added burden on the placement requirements of the conveying mechanism that is used to deposit a creased slip-sheets 40E into a slip-sheet holder. Further, nesting may not be possible when different sized creased slip-sheets are disposed into a single universal slip-sheet holder.

Figure 11A:
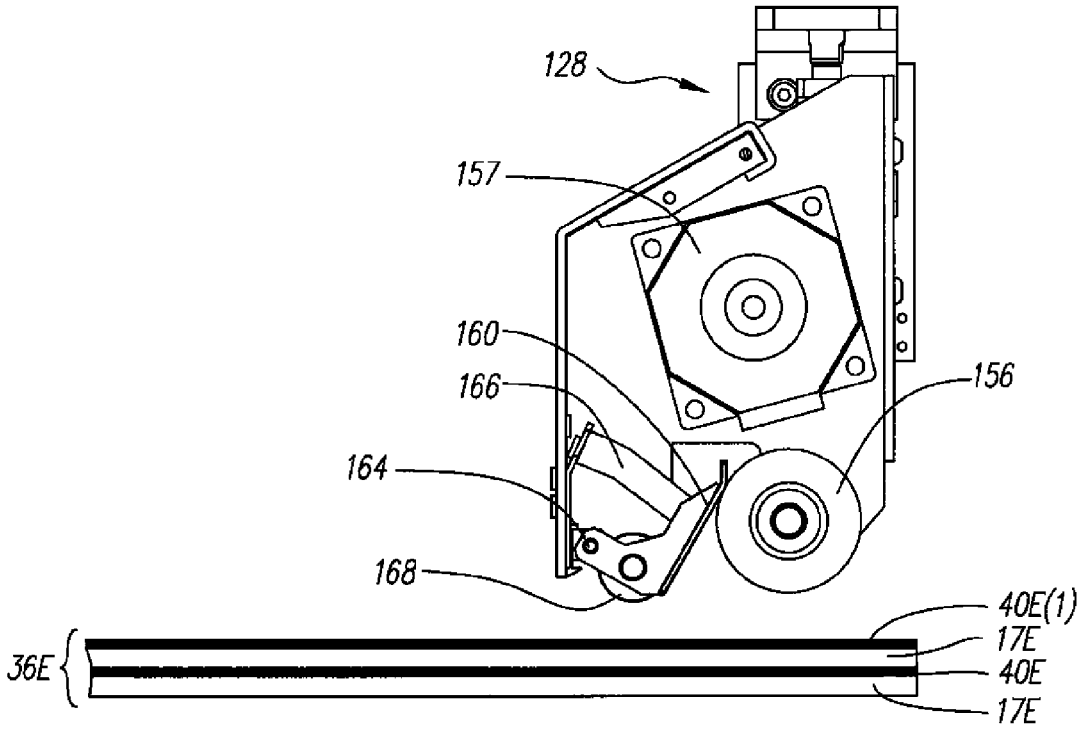
FIGS. 11A-11D schematically illustrates slip-sheet picker of FIG. 9 used with another sequence of steps to secure and separate a portion of an uppermost slip-sheet disposed on top of a media stack.
Figure 11B:
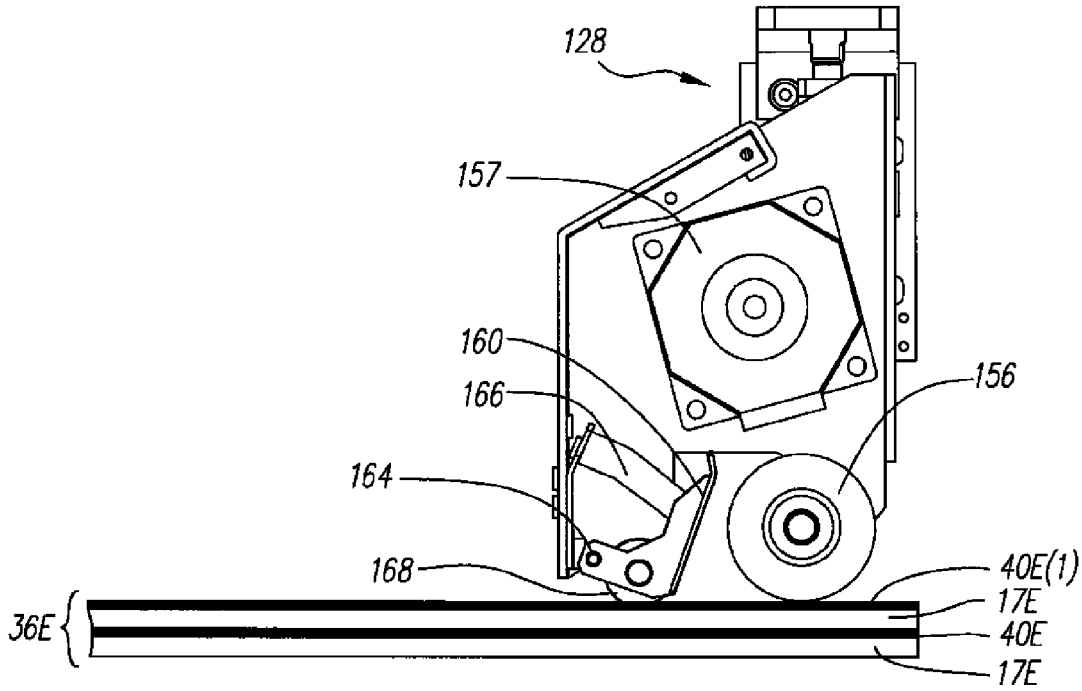
Figure 11C:
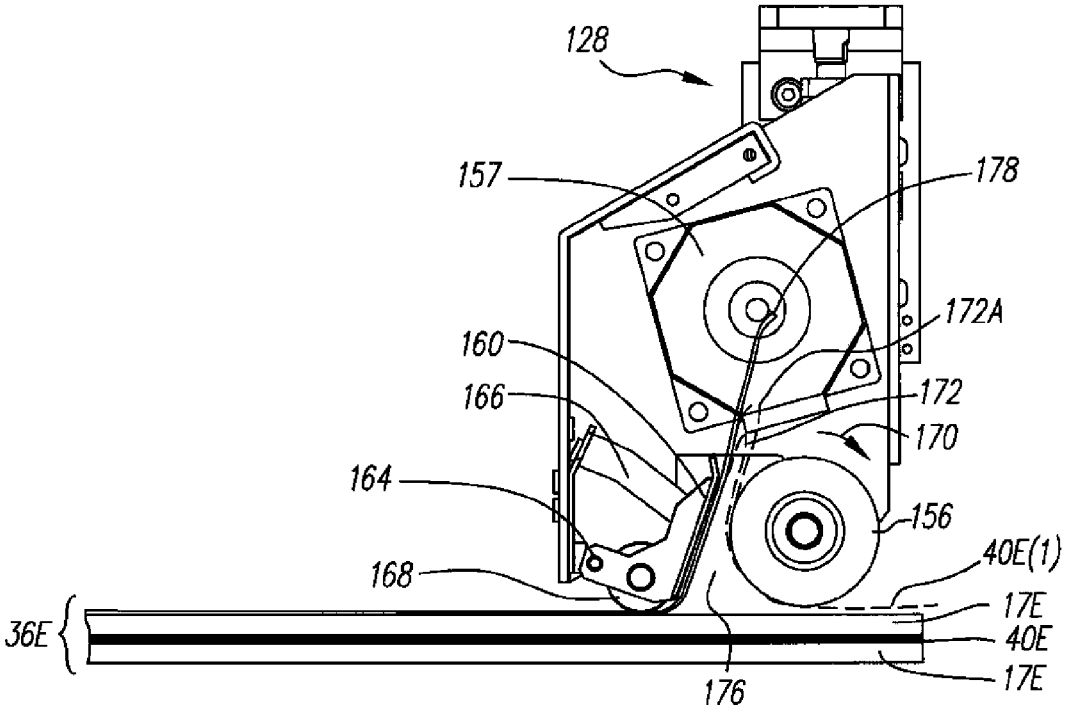

FIGS. 11A, 11B, 11C, and 11D show slip-sheet picker 128 used with another sequence of steps to engage and secure a portion of an uppermost slip-sheet 40E(1) disposed on top of a media stack 36E as per another example embodiment of this invention. Slip-sheet picker 128 is described for the purposes of illustration only, and it is to be understood that slip-sheet picker 126 can also work in a similar manner. FIGS. 11A and 11B can be used to describe steps that are essentially identical to the previously described steps associated with FIGS. 10A and 10B, and will not need further description. Like the step previously disclosed in reference to FIG. 10C, FIG. 11C shows that retraction roller 156 rotates in direction 170 to form loop 172 (shown in light ghosted lines). Unlike the steps associated with FIG. 10C, retraction roller 156 does not stop when loop 172 is formed but rather continues to rotate in direction 170 as shown in FIG. 11C. As retraction roller 156 continues to rotate, loop 172 increases in length as shown loop 172A (shown in heavy ghosted lines). Retraction roller 156 continues to rotate in direction 170 until slip-sheet 40E (1) is no longer pinched between retraction roller 156 and the underlying media stack 36E and partially constrained loop 172A exists in the space 176 that exists between retraction roller 156 and nipping member 160. Loop 172A is spring-like in nature and spacing 176 is sized to urge the unconstrained end of loop 172A against retraction roller 156 without creasing slip-sheet 40E(1). Retraction roller 156 continues to rotate in direction 170 and draws the unconstrained end of loop 172A out of space 176 to form slip-sheet 40E(1) free end 178. Retraction roller 156 can be moved out of contact with the underlying media stack 36E during the formation of free end 178 to reduce potential damage to a modifiable surface of an underlying image recordable material.

Figure 11D:
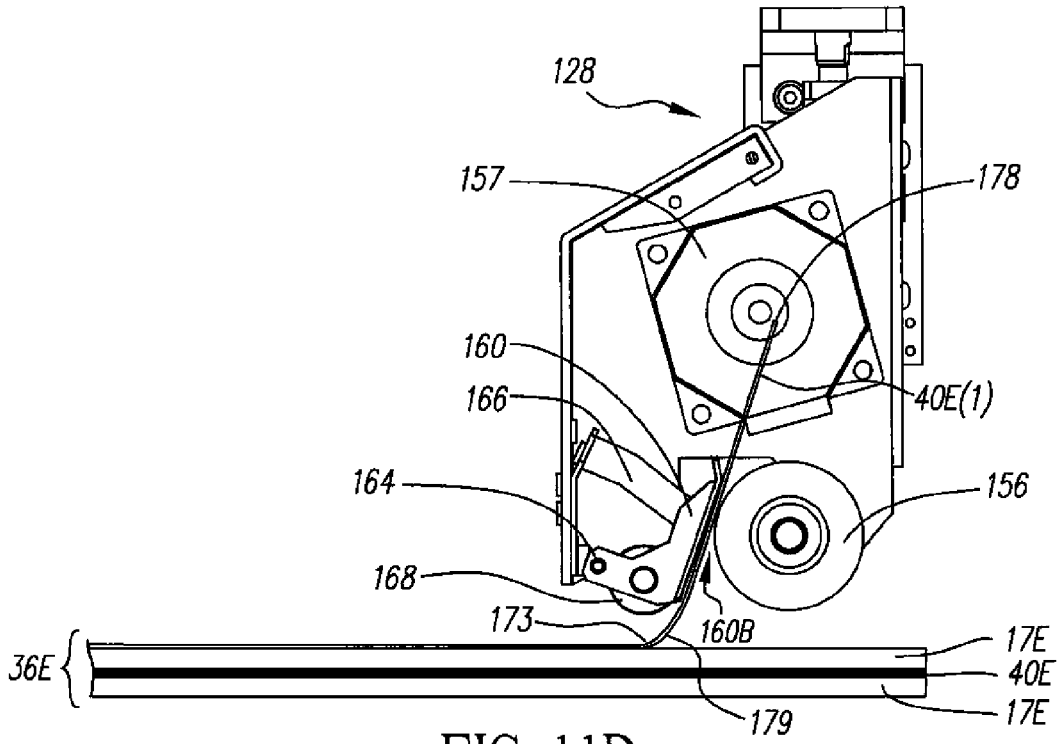

FIG. 11D shows the securing of free end 178. As per the steps previously described with respect to FIG. 10D, slip-sheet picker 128 is moved away from media stack 36E to cause nipping member 160 to rotate towards retraction roller 156 to form a contact nip 160B. However, unlike the example embodiment shown in FIG. 10D, contact nip 160B does not secure a loop of slip-sheet material but rather, slip-sheet free end 178. In this regard, nipping member 160 and retraction roller 156 each contact different surfaces (i.e. surface 173 and opposing surface 179, respectively) of slip-sheet 40E(1) when it is secured in the contact nip 160B and a crease or fold in a slip-sheet 40E(1) is avoided. Securing slip-sheet 40E(1) without creasing it can be used to overcome the previously described problems associated with creased slip-sheets 40E. Slip-sheet picker 128 can then be additionally further moved to further separate a secured slip-sheet 40E(1) from the underlying media stack 36E. Slip-sheet picker 128 can be moved to completely separate a secured slip-sheet 40E(1) from the underlying media stack 36E.

FIGS. 12A, 12B, 12C, 12D, 12E, 12F, 12G, 12H, 12I and 12J show an apparatus and associated order of operations for removing a slip-sheet from a media stack and depositing it in a slip-sheet holder.

Figure 12A:
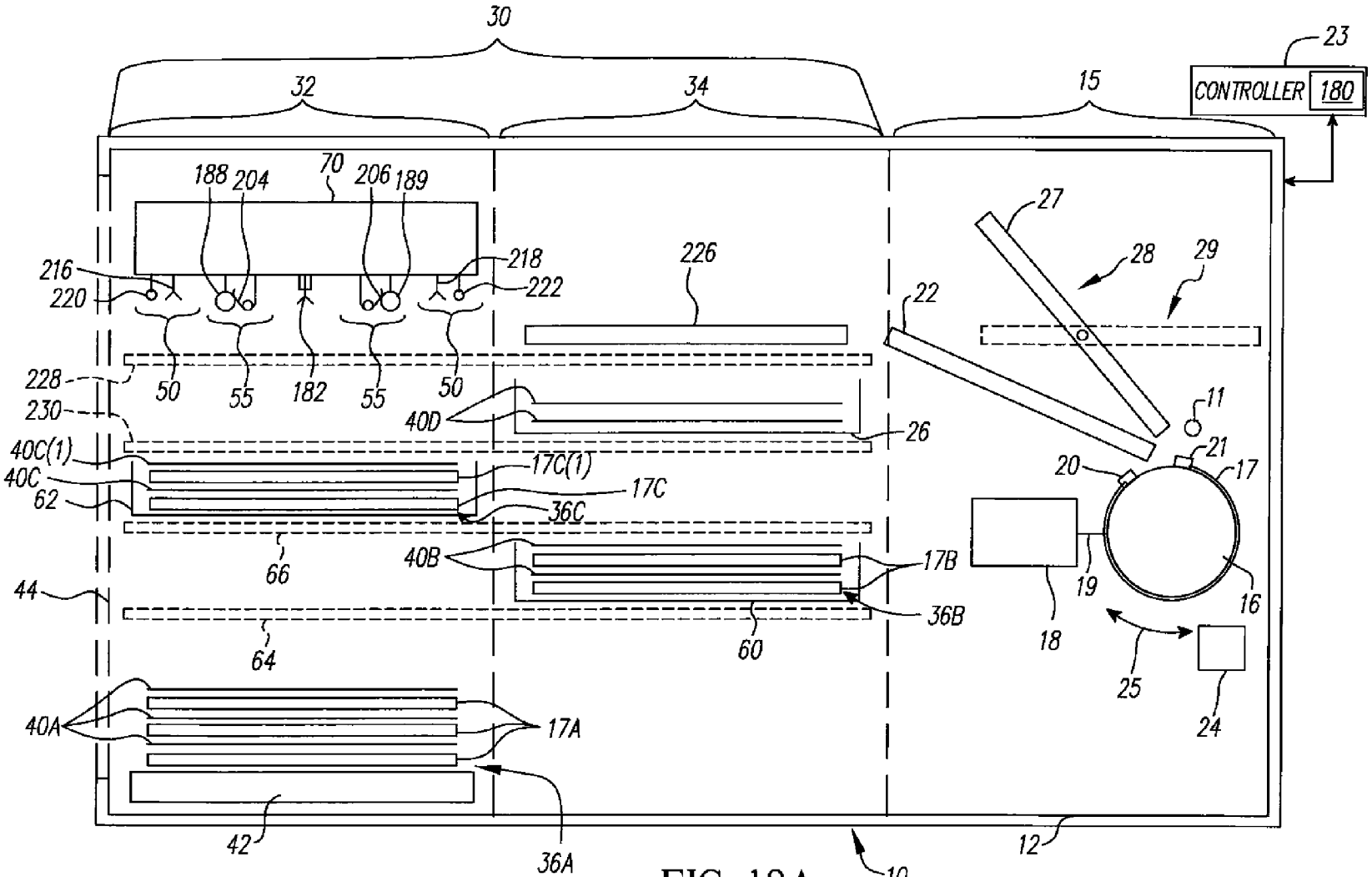
FIGS. 12A-12J schematically illustrates an apparatus and associated order of operations for removing a slip-sheet from a media stack and depositing it in a movable slip-sheet holder.

Referring to FIG. 12A, signals representative of image information data 180 are provided by controller 23. Image information data 180 can include data representative of the image to be formed on given image recordable material 17 as well as information identifying the particular characteristics the given image recordable material 17 must have. Characteristics include a required size of image recordable material 17. In this example, controller 23 has determined that image recordable materials 17C are required by image information data 180. Controller 23 provides signals to move media holder 62 from secondary media supply 34 along guides 66 into primary media supply 32. Media holder 62 includes media stack 36C that is made up of an interleaved assemblage of image recordable materials 17C and slip-sheets 40C. The uppermost sheet in media stack 36C is slip-sheet 40C(1), which is the same material as the other slip-sheets 40C. Separations between image recordable materials 17C and slip-sheets 40C with the media stack 36C are present for the purpose of clarity. These separations are standard throughout media stacks 36A, 36B and 36C.

Figure 12B:
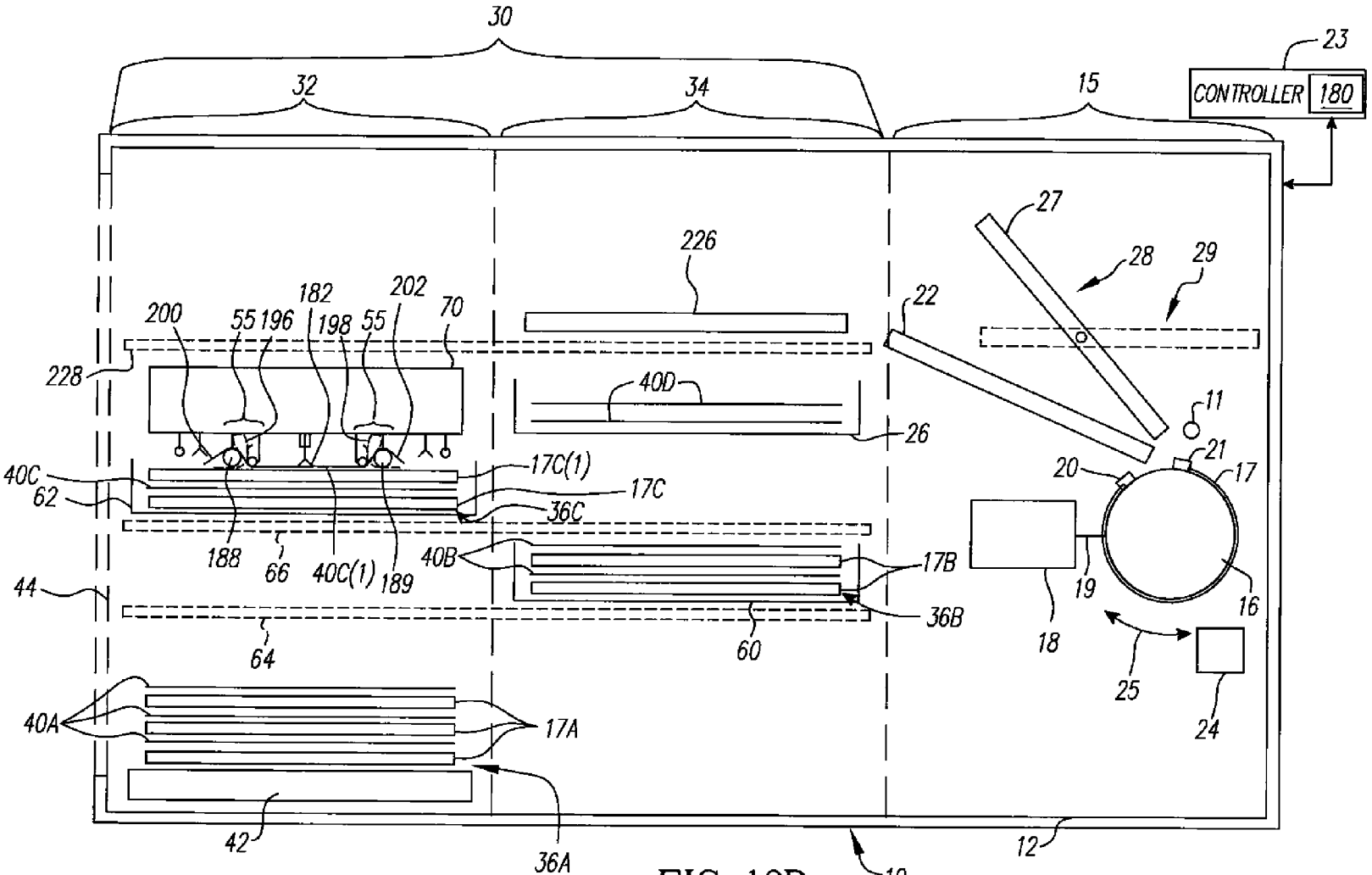

As shown in FIG. 12B, signals from controller 23 cause picking assembly 70 to move towards media stack 36C to engage slip-sheet 40C(1). Pinning member 182 pin slip-sheet 40C(1) to the rest of the underlying media stack 36C. Slip-sheet pickers 55 engage with slip-sheet 40C(1). Each of slip-sheet pickers 55 include retraction members 188 and 189. In this illustrated example, retraction members 188 and 189 include retraction rollers. Retraction members 188 and 189 are activated to laterally move end portions of slip-sheet 40C(1) to form loops 196 and 198 (shown in ghosted lines). Retraction members 188 and 189 are further activated to form free ends 200 and 202 from corresponding loops 196 and 198, respectively.

Figure 12C:
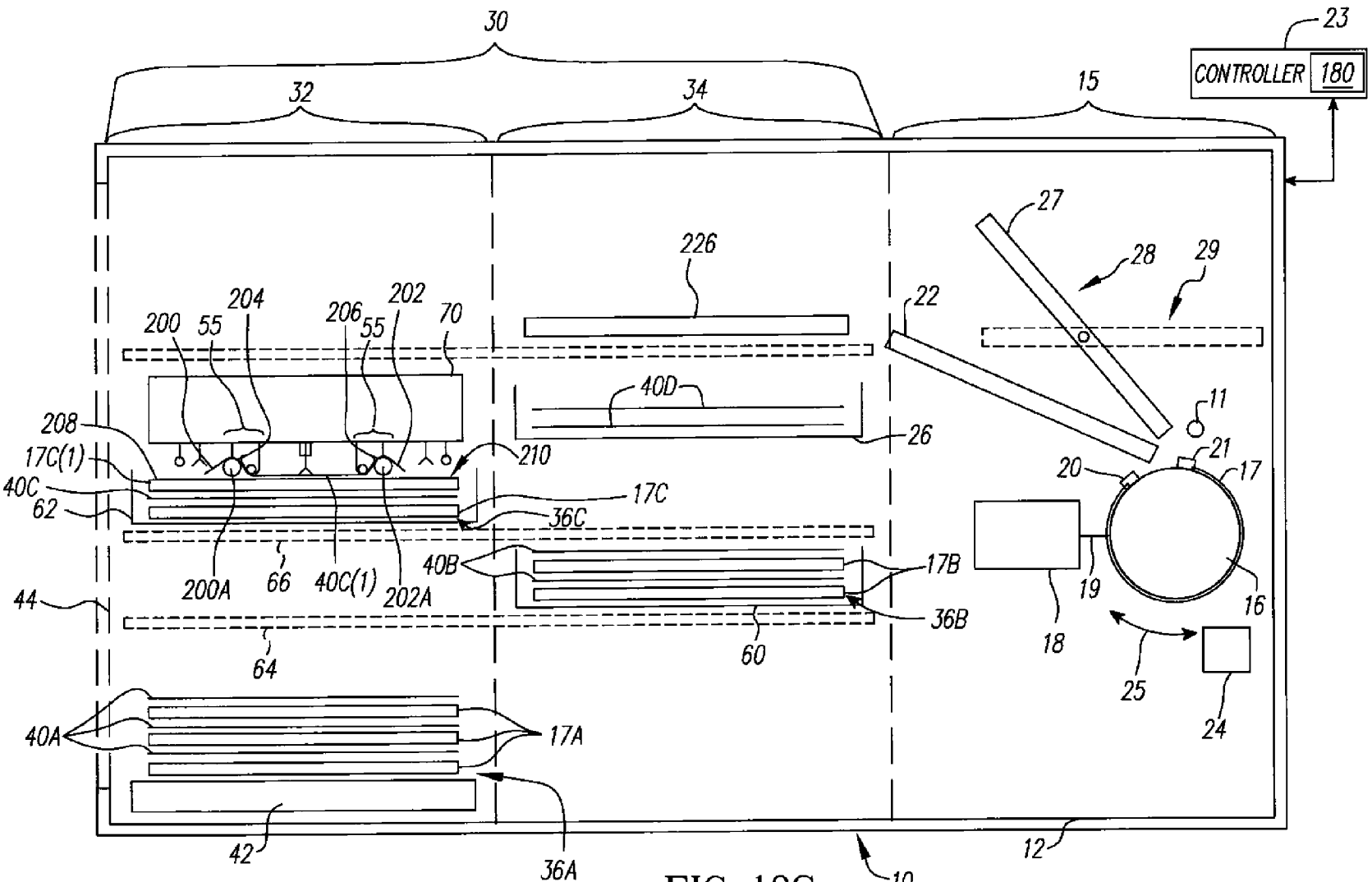

In FIG. 12C, slip-sheet pickers 55 secure corresponding free ends 200 and 202 in contact nips 200A and 202A, respectively, established by activating slip-sheet grippers 204 and 206. In this embodiment, free ends 200 and 202 are secured by moving slip-sheet pickers 55 away from media stack 36C. As shown in FIG. 12C, exposed portions 208 and 210 of uppermost image recordable material 17C(1), which is the same material as 17C, are exposed when free ends 200 and 202 are secured.

Figure 12D:
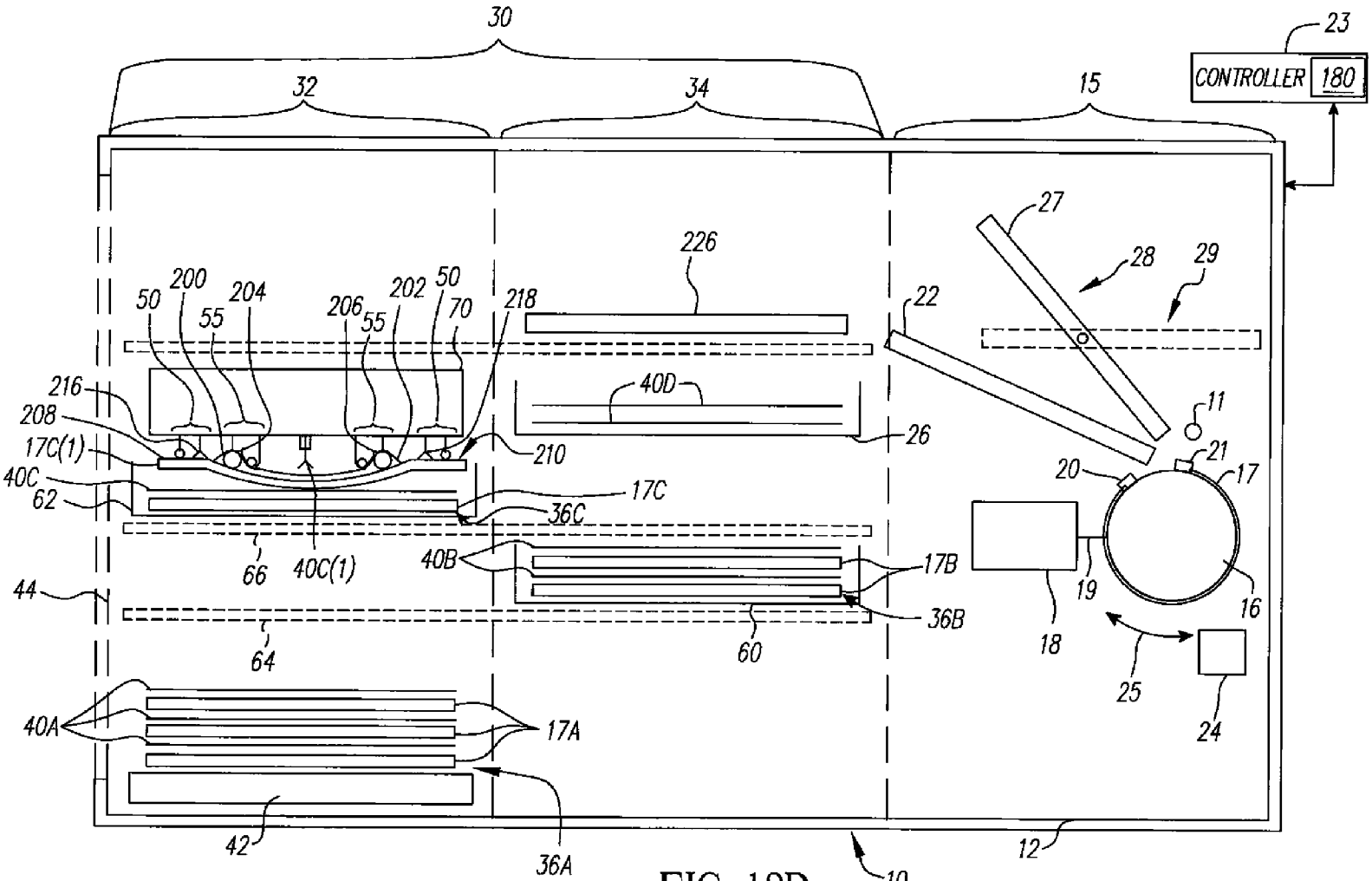
Figure 12E:
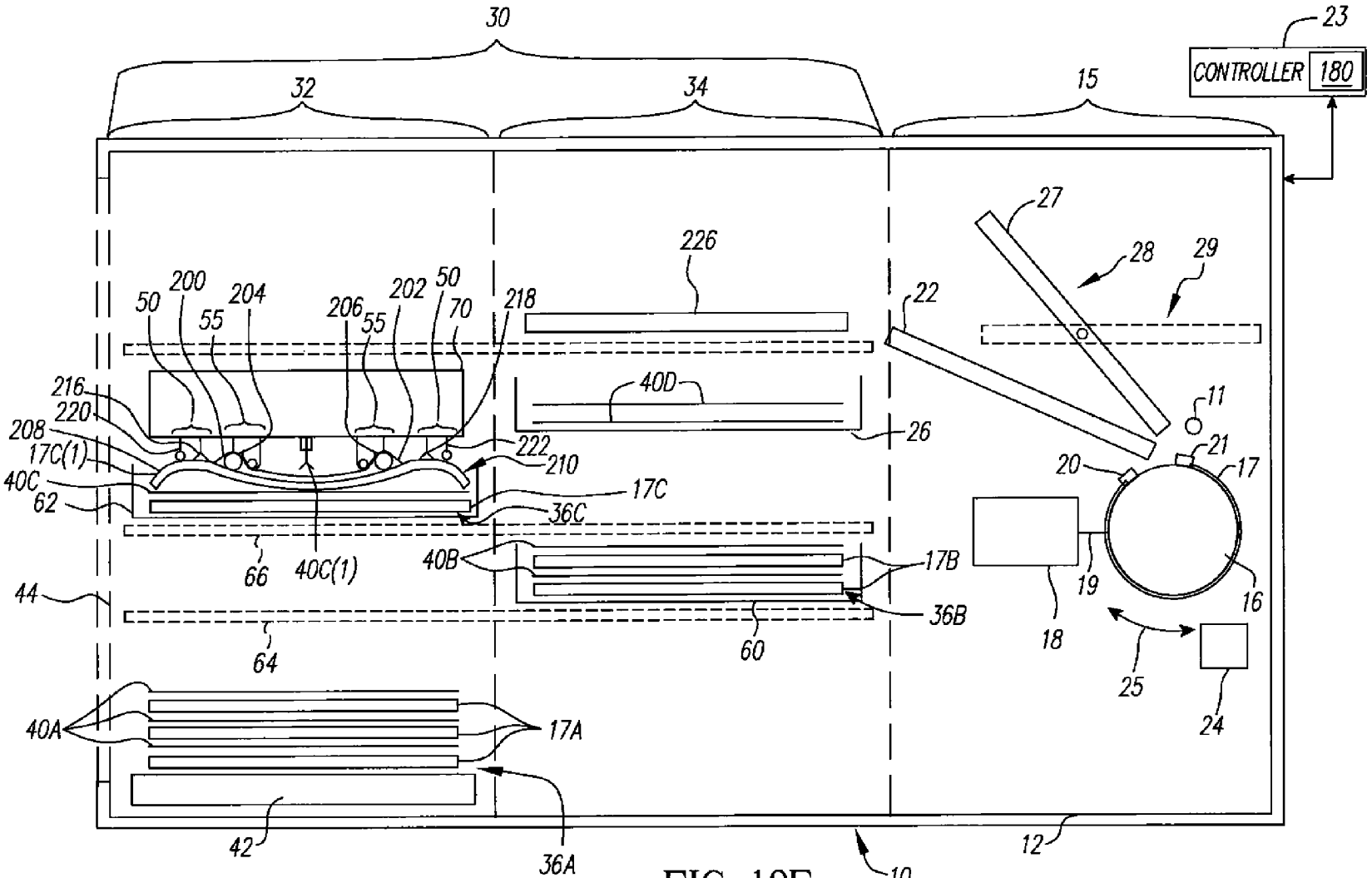
Figure 12F:
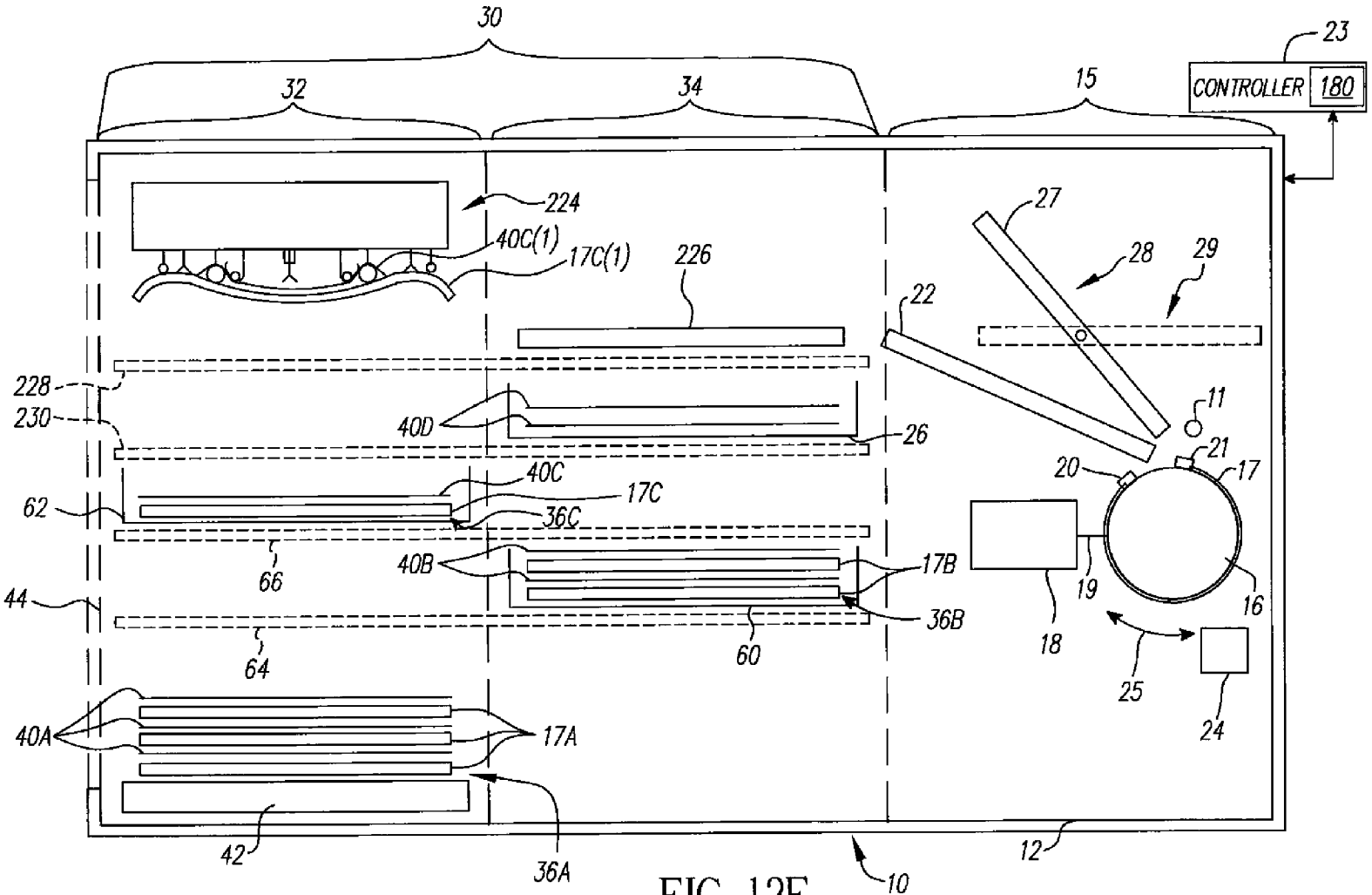

As shown in FIG. 12D, signals from controller 23 cause image recordable materials pickers 50 (herein referred to as materials pickers 50) to engage exposed portions 208 and 210 of image recordable material 17C(1). Gripping members 216 and 218 grip exposed portions 208 and 210 and bend the portions away from the rest of media stack 36C. Again, full separations between slip-sheet 40C(1) and image recordable material 17C(1) are shown for the sake of clarity. Pinning members 182 can pin slip-sheet 40C(1) and image recordable material 17C(1) to the rest of media stack 36C to prevent the shifting of media stack 36C. Here, gripping members 216 and 218 include suction mechanisms. In other embodiments, exposed portions 208 and 210 are gripped at an earlier point in time. Exposed portions 208 and 210 can be gripped as soon as end portions of slip-sheet 40C(1) are laterally moved to create exposed portions 208 and 210. As shown in FIG. 12E, flexing members 220 and 222 are activated to flex gripped exposed portions 208 and 210 towards media stack 36C. Flexing exposed portions 208 and 210 is used to separate one or more slip-sheets 40C and/or image recordable materials 17C that may have adhered to image recordable material 17C(1). Flexing members 220 and 222 can be used to establish one or more compound curves in at least one of exposed portions 208 and 210. Controller 23 can cause flexing members 220 and 222 to repeatedly flex at least one of exposed portions 208 and 210. Controller 23 can cause flexing members 220 and 222 to flex at least one of exposed portions 208 and 210 towards the rest of media stack 36C. Controller 23 can cause flexing members 220 and 222 to flex at least one of exposed portions 208 and 210 away from the rest of media stack 36C. As shown in FIG. 12F, secured slip-sheet 40C(1) and secured image recordable material 17C(1) are moved away from media stack 36C to transfer position 224. Secured slip-sheet 40C(1) and secured image recordable material 17C(1) can be moved along a same path. Secured slip-sheet 40C(1) and secured image recordable material 17C(1) can be moved concurrently. Secured slip-sheet 40C(1) and secured image recordable material 17C(1) can be moved in tandem. After secured slip-sheet 40C(1) and secured image recordable material 17C(1) are at transfer position 224, transfer support 226 and slip-sheet holder 26 are moved into primary media supply 32 along guides 228 and 230, respectively, as shown in FIG. 12G.

Figure 12G:
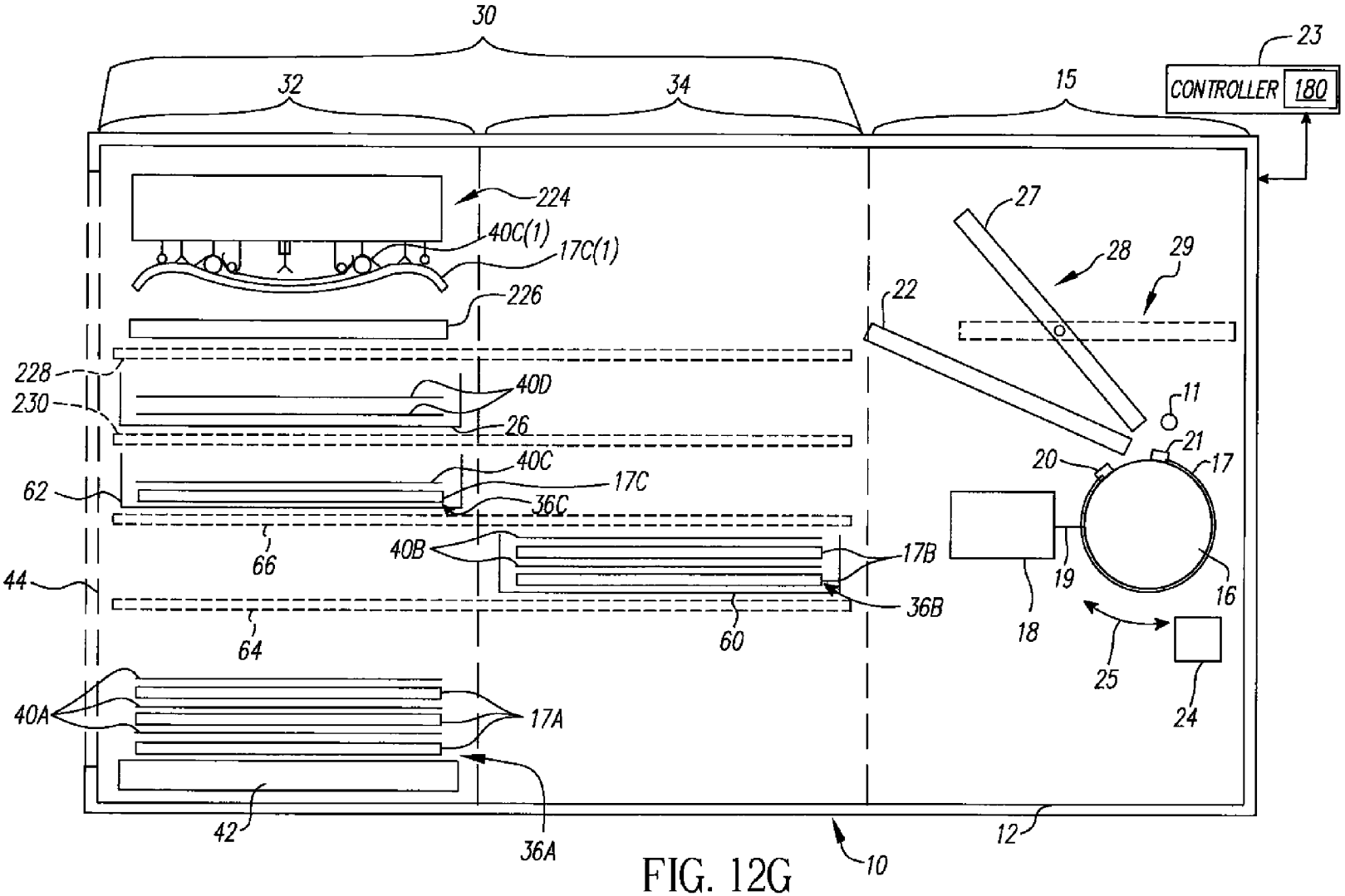

As shown in FIG. 12G, slip-sheet holder 26 is used to collect removed slip-sheets 40D. In this illustrated embodiment, slip-sheet holder 26 contains a stack of slip-sheets 40D that have been previously deposited into slip-sheet holder 26. Transfer support 226 and slip-sheet holder 26 can be moved concurrently into primary media supply 32 to reduce the overall time required. Each media holders 60 and 62 can remain stationary or move independently from or to primary media supply 32 as required by controller 23 as it processes image data information 180 associated with a next image recordable material. Either media holder 60 or media holder 62 can move or remain stationary during the movement of secured slip-sheet 40C(1) and secured image recordable material 17C(1) to transfer position 224. Either media holder 60 or media holder 62 can move or remain stationary during the movement of transfer support 226 and/or slip-sheet holder 26.

Figure 12H:
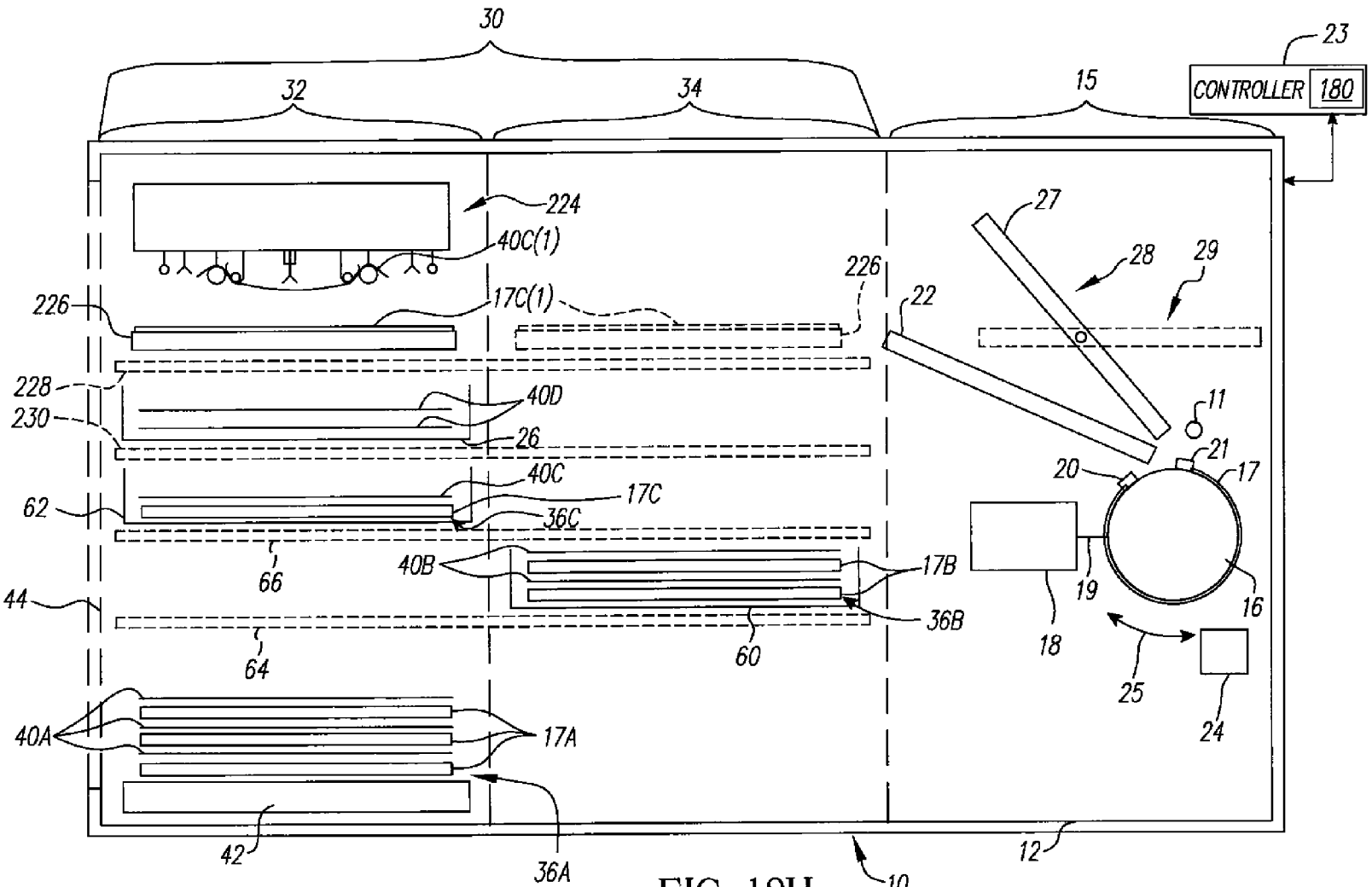

Referring to FIG. 12H, when transfer support 226 is positioned within primary media supply 32 in the vicinity of picking assembly 70 positioned at transfer position 224, pickers 50 release and deposit secured image recordable material 17C(1) onto transfer support 226. Image recordable material 17C(1) is released to fall onto transfer support 226. Relative motion between pickers 55 and transfer support 226 can be established to directly place image recordable material 17C(1) onto transfer support 226. Upon the deposit of image recordable material 17C(1), transfer support 226 (shown in ghosted lines) conveys image recordable material 17C(1) from the primary media supply 32 to a subsequent process.

Figure 12I:
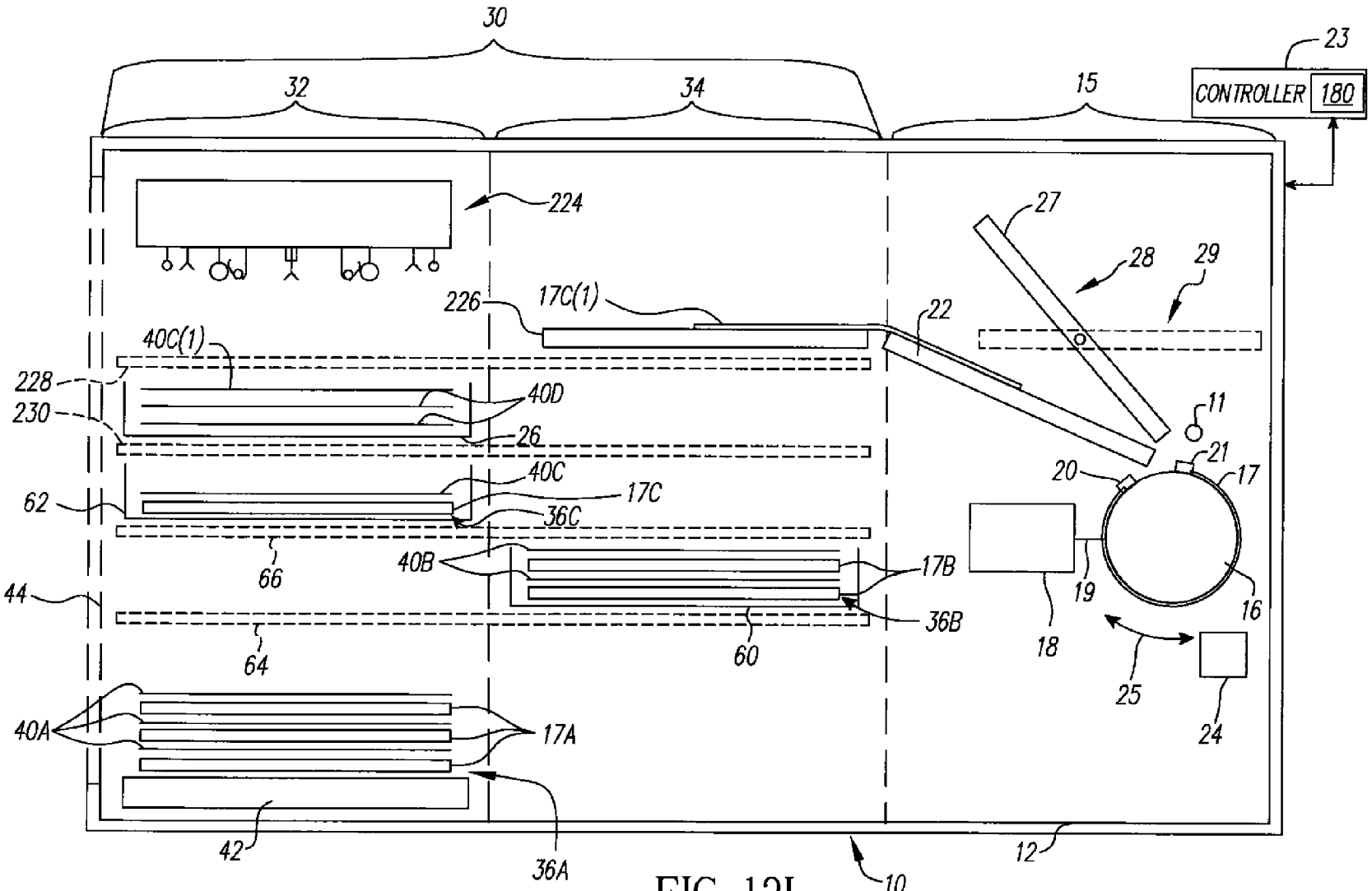
Figure 12J:
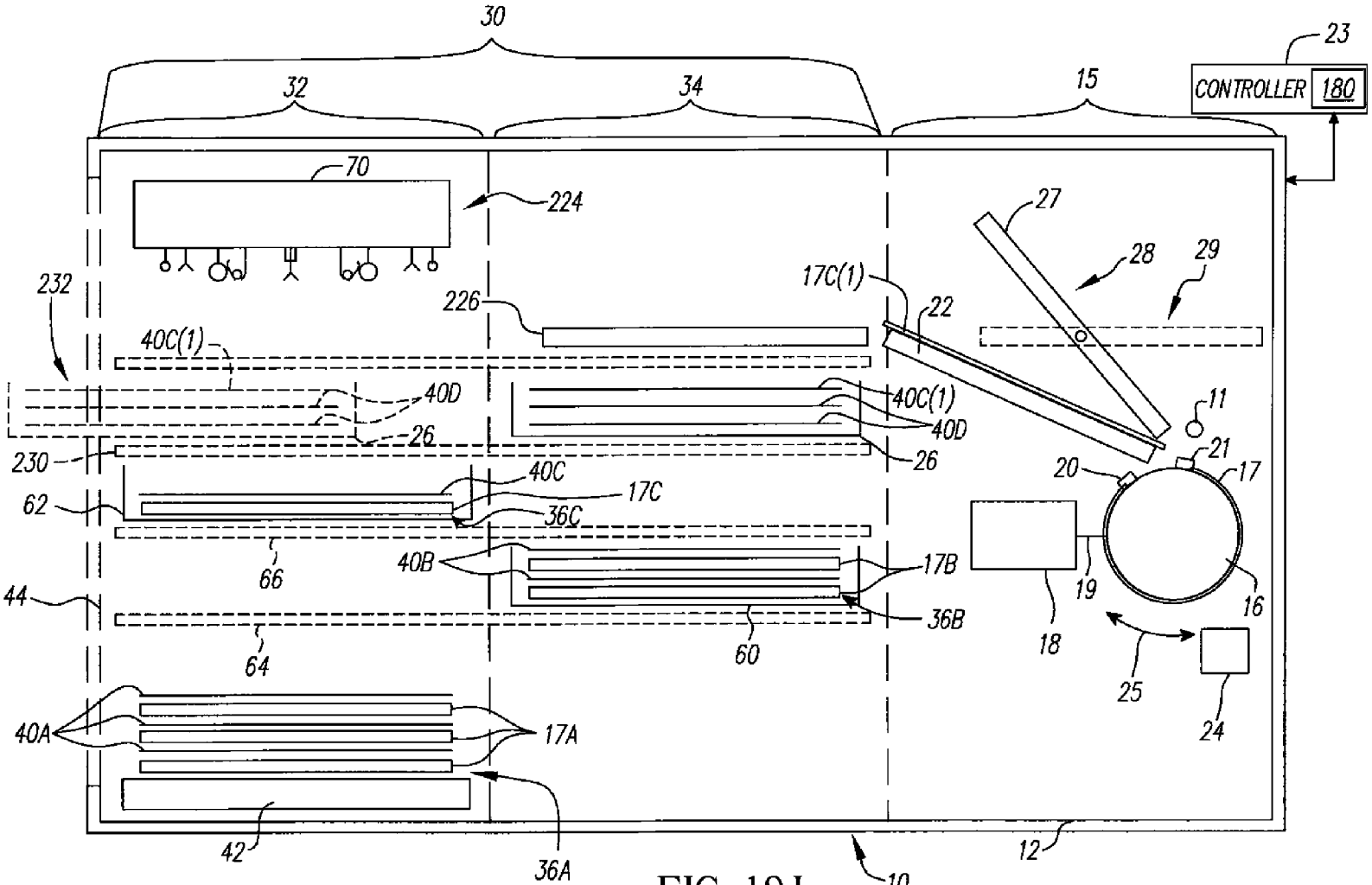

Referring to FIGS. 12I and 12J, image recordable material 17C(1) is transferred to loading support 22, from which it is subsequently loaded onto exposure support 16 to be imaged in accordance with image information data 180. In other embodiments, imaged recordable material 17C(1) can be transferred to other subsequent processes (e.g. punching in a punching assembly). When transfer support 226 has moved from primary media supply 32, slip-sheet pickers 55 release and deposit secured slip-sheet 40C(1) into slip-sheet holder 26. Slip-sheet 40C(1) can be directly placed into slip-sheet holder 26, or may fall into slip-sheet holder 26. In this illustrated embodiment, slip-sheet 40C(1) is positioned on a previously deposited slip-sheets 40D that conform to planar surface of slip-sheet holder 26. A lack of creases, e.g., permanent folds, in both of slip-sheets 40C(1) and 40D allows the slip-sheets to be stacked in a planar fashion. The space required to store stacked slip-sheets is advantageously reduced when they are planar. As shown in FIG. 12J, slip-sheet holder 26 is moved back to secondary media supply 34 and picking assembly 70 can be positioned to secure and remove another image recordable material and slip-sheet.

The apparatus and associated operational steps corresponding to the example embodiment of the invention illustrated in FIGS. 12A to 12J reduce the systems throughput times and increase overall system reliability. The securement of slip-sheet 40C(1) exposes portions of underlying image recordable material 17C(1) that can in turn be secured without requiring the removal of secured slip-sheet 40C(1). Secured image recordable material 17C(1) is further flexed into a shape that facilitates the separation of secured slip-sheet 40C(1) and/or any additional sheets that may be adhered to a surface of image recordable 17C(1). Secured image recordable material 17C(1) can be flexed without requiring the removal of secured slip-sheet 40C(1). Secured slip-sheet 40C(1) and image recordable material 17C(1) are concurrently conveyed to a point where image recordable material 17C(1) is conveyed to a subsequent process and secured slip-sheet 40C(1) is deposited directly slip-sheet holder 26. Moving slip-sheet holder 26 to a position below secured slip-sheet 40C(1) reduces the need for additional mechanism that would be needed to additionally secure a flimsy material like slip-sheet 40C(1) and convey it along a different path to a fixed slip-sheet holder.

Depositing secured slip-sheet 40C(1) directly into slip-sheet holder 26 which has been moved into a position below it allows slip-sheets 40C(1) to be stacked in a planar fashion to help reduce the amount of space that would be required to store it. Slip-sheet holder 26 can be emptied by an operator when it is within either primary media supply 32 or secondary media supply 34 as dictated by the presence of suitable access ports within housing 12. The movable nature of slip-sheet holder 26 can also allow it to be moved to a removal position 232 (shown in ghosted lines in FIG. 12J) which can completely or partially extend outside housing 12 to facilitate a removal of materials.

Figure 13:
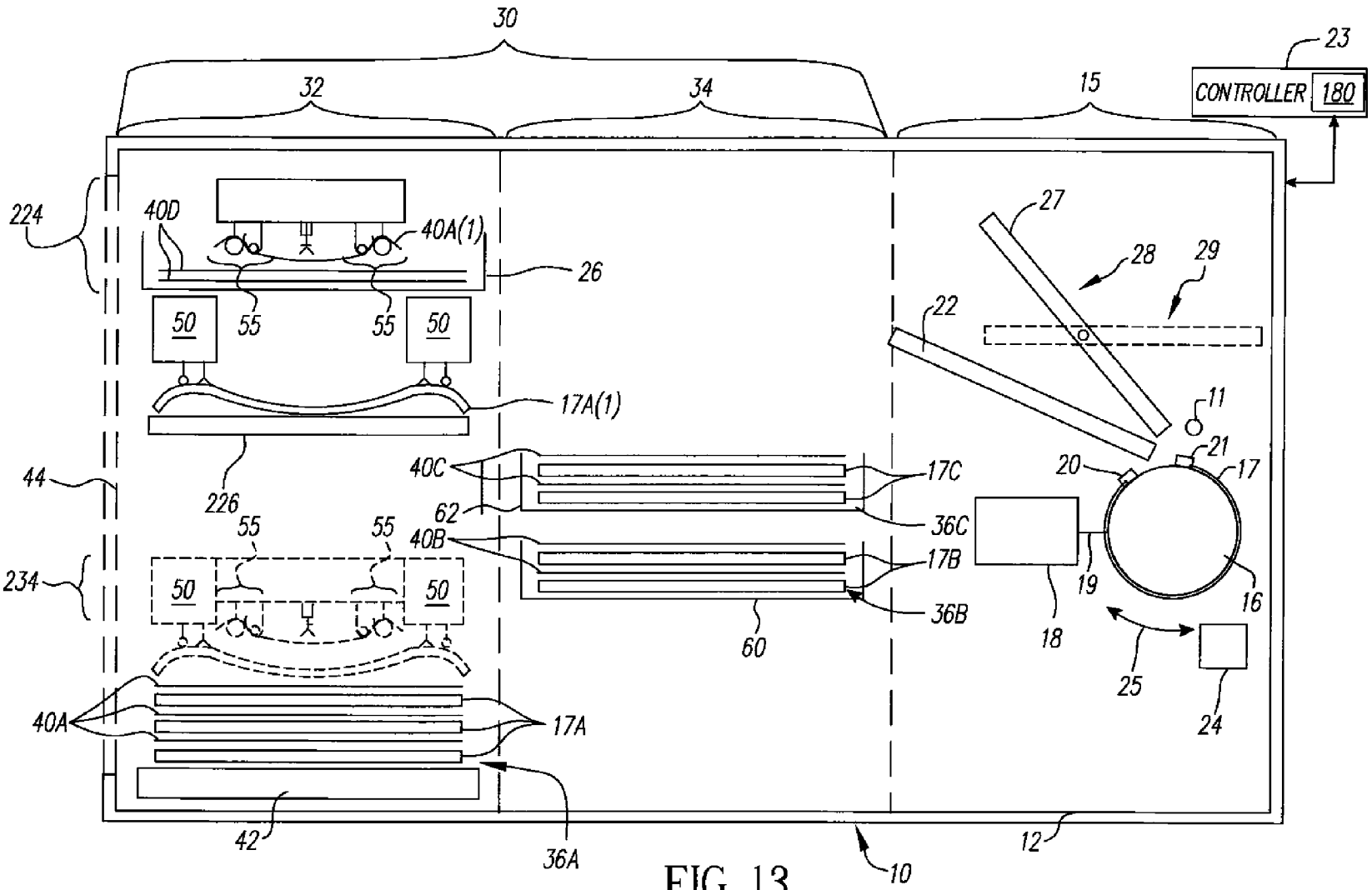
FIG. 13 schematically illustrates another apparatus for removing a slip-sheet from a media stack and depositing it in a movable slip-sheet holder.

Picking assembly 70 can include an assembly of slip-sheet pickers 55 that are fixed or movable with respect to materials pickers 50. FIG. 13 shows another embodiment where slip-sheet pickers 55 (shown in ghosted lines) are nested together with materials pickers 50 (also shown in ghosted lines) at a first position 234 proximate media stack 36A but are separated from one another at a transfer position 224 away from media stack 36C (slip-sheet pickers 55 and materials pickers 50 being shown in solid lines at transfer position 224). Materials are secured and removed from media stack 36A as previously described, and materials can also be secured and removed from media stacks 36B and 36C in a similar manner.

Suitable mechanisms for separating slip-sheet pickers 55 from materials pickers 50 can include elements made up of, but not limited to: electric motors, timing belts, gears, chains, pneumatic or hydraulic cylinders etc. The separation of slip-sheet pickers 55 from materials pickers 50 can be initiated at first position 234, or on route to, or at transfer position 224.

Slip sheet pickers 55 186 are sufficiently separated from pickers 50 to allow slip-sheet holder 26 to move there between. At transfer position 224, slips-sheet pickers 55 can deposit secured slip-sheet 40A(1) into slip-sheet bin 26 at substantially the same time as secured image recordable material 17A(1) is deposited on transfer support 226 for conveyance to a subsequent process, thus allowing for a further improvement in the system throughput.

The invention has been described in detail with particular reference to certain preferred embodiments thereof, but it will be understood that variations and modifications can be effected within the spirit and scope of the invention.

While a number of exemplary aspects and embodiments have been discussed above, those of skill in the art will recognize certain modifications, permutations, additions and sub-combinations thereof. For example:

The embodiments described above make use of controllers for controlling various components using various control signals and/or implementing various methods. Such controllers may be configured to execute suitable software and may comprise one or more data processors, together with suitable hardware, including by way of non-limiting example: accessible memory, logic circuitry, drivers, amplifiers, A/D and D/A converters, input/output ports and the like. Such controllers may comprise, without limitation, a microprocessor, a computer-on-a-chip, the CPU of a computer or any other suitable microcontroller. The controllers associated with the materials handling system described above may be, but need not necessarily be, the same controllers that control the operation of the corresponding exposure systems.

The controllers described above make use of control signals to control various components of the materials handling system. Those skilled in the art will appreciate that such control signals may each comprise pluralities of signals that may be transmitted from the controller to the component and/or from the component to the controller. The controllers may comprise or otherwise work in conjunction with suitable hardware or software to effect control of the various components. Such control signals may also comprise "open loop" control signals that rely on predetermined calibration and do not specifically incorporate feedback from sensors.

PARTS LIST

10 image recording system
11 roller
12 housing
15 exposure system
16 exposure support
17, 17A, 17A(1), 17B, 17C, 17C(1), 17E, 17E(1) image recordable material
18 imaging head
19 radiation beam
20 leading edge clamp
21 trailing edge clamp
22 loading support
23 controller
24 drive
25 main-scan direction
26 slip-sheet holder
27 unloading support
28 first position
29 second position
30 materials handling system
32 primary media supply
34 secondary media supply
36A, 36B, 36C, 36E media stack
40A, 40A(1), 40B, 40C, 40C(1), 40D, 40E, 40E(1) slip-sheet
42 media holder
44 access port
50 image recordable materials picker (also known as materials picker)
55 slip-sheet picker
60, 62 media holder
64, 66 guide
70 picking assembly
71 vertical drive system
72 electrical motor
74 drive pulleys
76 driven pulleys
78, 80 timing belts
82 drive shaft
84 linear rail
86 linear bearing
88 drive side
90 channel
92 weights
94 linear rails
96 fluid actuators
98 fixed point
100 non-drive side
102 timing belts
104 first attachment point
106, 108, 110 idler pulleys
112 second attachment point
114 sensor
120 pinning mechanism
122, 124 image recordable material pickers (also known as pickers)
126, 128 slip-sheet pickers
130 suction mechanisms
130A gripping members
131 groups
132 directions
133 compliance member
134 slots
136 directions
138 slots
138A directions
140 pinning members
142, 142A flexing members
143 plungers
143A extend plungers
144 picker
145 edge
145, 147 side edges
148, 149 bend corners
150 roller mechanism
152 nipping mechanism
154, 156 retraction rollers
157 electric motor
158 shaft
159 clutch
160 nipping member
160A, 160B contact nip
162 support
164 pivot pin
166 biasing member
168 clamping roller
170 direction
172, 172A loop

173 surface
174 apex
176 space
178 free end
179 opposing surface
180 imaging information data
182 pinning member
188, 189 retraction members
196, 198 loops
200 free end
200A contact nip
202 free end
202A contact nip
204 slip-sheet gripper
206 slip-sheet gripper
208, 210 exposed portions
216, 218 gripping members
220, 222 flexing members
224 transfer position
226 transfer support
228, 230 guide
232 removal position
234 first position
Δ spacing

The invention claimed is:

1. An apparatus for storing a slip-sheet, comprising:

a media holder for supporting a media stack that includes the slip-sheet located at a first position, the media stack including one or more slip-sheets and one or more image recordable materials;

a picker for securing the slip-sheet at the first position and moving the slip-sheet to a second position;

a slip-sheet holder for depositing the slip-sheet into after the slip-sheet holder is moved from a third position to a fourth position, the slip-sheet holder positioned at the fourth position being in the vicinity of the slip-sheet positioned at the second position; and wherein the picker includes a buckler and a nipping member.

2. The apparatus of claim 1, wherein the picker grips the slip-sheet at the first position.

3. The apparatus of claim 1, wherein the second position is vertically higher than the first position.

4. The apparatus of claim 1, wherein the fourth position is located sideward from the third position.

5. The apparatus of claim 1, wherein the slip-sheet holder comprises a surface, wherein a surface of the slip-sheet substantially conforms to the surface of the slip-sheet holder after being deposited into the slip-sheet holder.

6. The apparatus of claim 1, wherein a surface of the slip-sheet is substantially planar after being deposited into the slip-sheet holder.

7. The apparatus of claim 1, wherein the slip-sheet holder comprises at least one surface for supporting a plurality of slip-sheets.

8. The apparatus of claim 1, wherein the picker is configured for securing a plurality of slip-sheets at the first position and depositing the plurality of slip-sheets into the slip-sheet holder positioned at the fourth position.

9. The apparatus of claim 1, wherein the picker is configured for stacking the slip-sheet on top of an additional slip-sheet contained in the slip-sheet holder at the fourth position.

10. The apparatus of claim 9, wherein the picker is configured for stacking the slip-sheet substantially horizontally and without any creases when the slip-sheet is deposited into the slip-sheet holder.

11. An apparatus for storing a slip-sheet, comprising:

a media holder for supporting a media stack that includes the slip-sheet located at a first position, the media stack including one or more slip-sheets and one or more image recordable materials;

a picker for securing the slip-sheet at the first position and moving the slip-sheet to a second position;

a slip-sheet holder for depositing the slip-sheet into after the slip-shed holder is moved from a third position to a fourth position, the slip-sheet holder positioned at the fourth position being in the vicinity of the slip-sheet positioned at the second position; and further comprising an image recordable material picker for separating an image recordable material from the media stack and moving the image recordable material to a position in the vicinity of the slip-sheet positioned at the second position.

12. The apparatus of claim 11, further comprising a controller configured to effect relative motion between the picker, the image recordable material picker and the media stack, such that the image recordable material is moved while moving the slip-sheet from the first position to the second position.

13. The apparatus of claim 12, wherein the controller is configured to activate the image recordable material picker to deposit the image recordable material onto a transfer support before the slip-sheet is deposited into the slip-sheet holder.

* * * * *

UNITED STATES PATENT AND TRADEMARK OFFICE

CERTIFICATE OF CORRECTION

PATENT NO. : 7,744,078 B2
APPLICATION NO. : 11/668550
DATED : June 29, 2010
INVENTOR(S) : Jo A. L. Gramadzki et al.

It is certified that error appears in the above-identified patent and that said Letters Patent is hereby corrected as shown below:

| Issued Patent | | Description of Error |
|---|---|---|
| **Column** | **Line** | |
| 22 | 28 | In Claim 11, delete "slip-shed" and insert -- slip-sheet -- |

Signed and Sealed this

Fifth Day of October, 2010

David J. Kappos

David J. Kappos
*Director of the United States Patent and Trademark Office*